US006499273B1

(12) United States Patent
Marzocchi

(10) Patent No.: US 6,499,273 B1
(45) Date of Patent: Dec. 31, 2002

(54) MACHINE FOR ATTACHING A TAG TO AN INFUSION BAG USING AN INTERMEDIATE KNOTTED THREAD

(75) Inventor: Paolo Marzocchi, Castel S. Pietro Terme (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 0 days.

(21) Appl. No.: 09/530,806

(22) PCT Filed: Sep. 16, 1999

(86) PCT No.: PCT/IB99/01550

§ 371 (c)(1),
(2), (4) Date: May 5, 2000

(87) PCT Pub. No.: WO00/17055

PCT Pub. Date: Mar. 30, 2000

(30) Foreign Application Priority Data

Sep. 18, 1998 (IT) ..... B098A0536

(51) Int. Cl.[7] ..... B65B 29/04

(52) U.S. Cl. ..... 53/413; 53/134.1; 53/134.2; 493/226; 493/375; 493/376

(58) Field of Search ..... 53/134.1, 134.2, 53/413; 493/226, 375, 376

(56) References Cited

U.S. PATENT DOCUMENTS

| | | | | | |
|---|---|---|---|---|---|
| 3,940,169 | A | * | 2/1976 | Kock | 289/1.5 |
| 4,790,254 | A | | 12/1988 | Vornholt | |
| 4,977,728 | A | | 12/1990 | Rambold | |
| 5,399,224 | A | * | 3/1995 | Vernon et al. | 156/265 |
| 5,527,419 | A | * | 6/1996 | Vernon et al. | 156/443 |
| 5,657,712 | A | * | 8/1997 | Romagnoli | 112/156 |
| 5,797,243 | A | * | 8/1998 | Tagliaferri et al. | 206/5 |

FOREIGN PATENT DOCUMENTS

| | | | |
|---|---|---|---|
| DE | 26 23 796 | 6/1977 | |
| EP | 0489 554 A1 | 6/1992 | |
| EP | 0 691 268 | 1/1996 | |
| WO | 96/31395 | 10/1996 | |
| WO | 9631395 | * 10/1996 | B65B/29/04 |

* cited by examiner

*Primary Examiner*—Scott A. Smith
*Assistant Examiner*—Thanh Truong
(74) *Attorney, Agent, or Firm*—Arent Fox Kintner Plotkin & Kahn

(57) ABSTRACT

An improved machine (1) for making filter bags (2) containing a product for infusion, with a pick-up tag (3) connected to the top (12) of the filter bag (2) by an intermediate thread (5), comprises a wheel (6) which rotates with a stepping motion about its own axis of rotation (16) and is equipped with grippers (7) which are brought into contact with a series of operating stations, comprising at least one station (9) for folding a tubular semi-finished product (20) containing the product for infusion, and at least one station (15) for knotting the thread (5). The machine (1) has thread (5) feed means (33, 34, 35) which operate on the thread (5) fed between consecutive pairs of the grippers (7) along the edge of the wheel (6) so as to prevent it from sliding backwards. The thread (5) knotting station (15) is equipped with needles (45) which have a first and second eye (51, 52) positioned at different distances from the point. The needles (45) are moved in such a way as to pick up the thread (5) with the second eye (52), forming a loop (62) in which the thread (5) is associated with the first eye (51), interceptor elements (54) being moved in time with the needles (45) so that they passe through the first eye (51), pushing a section of thread (5) through the loop (62). The invention also relates to a method for knotting the thread (5).

42 Claims, 22 Drawing Sheets

FIG.3
FIG.3A
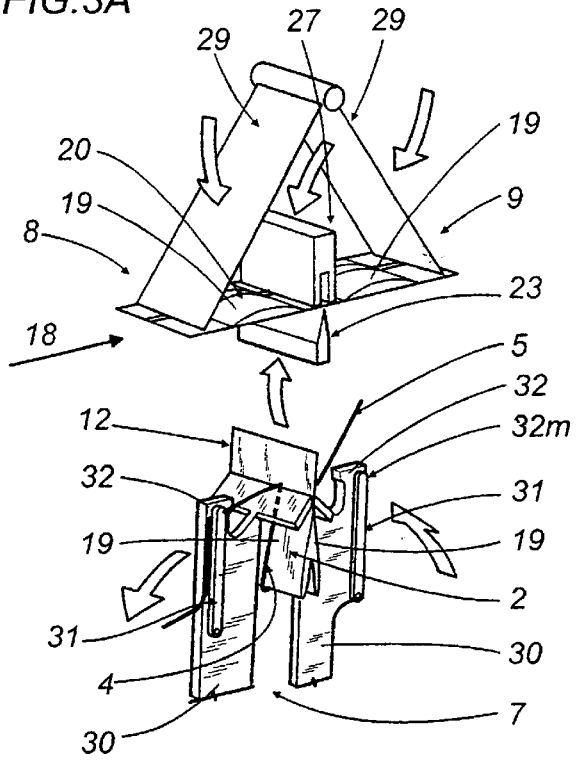
FIG.3B
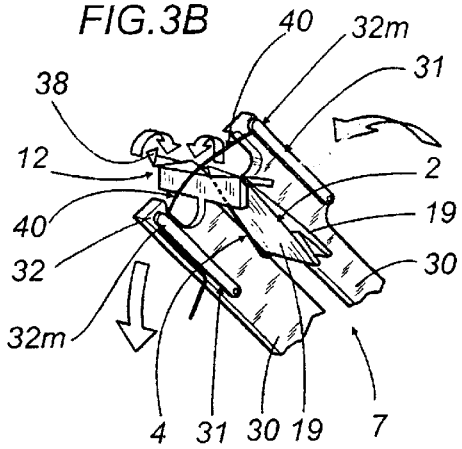
FIG.3C
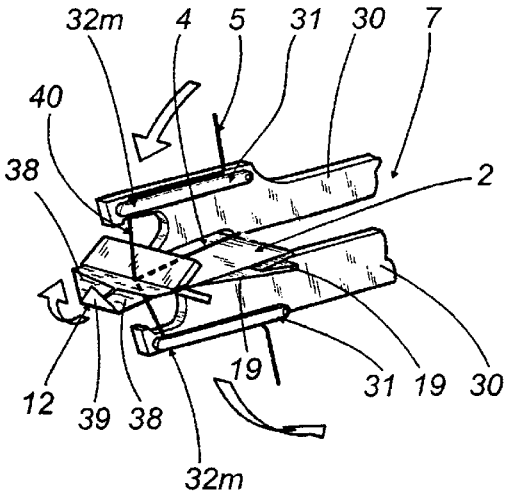
FIG.3D
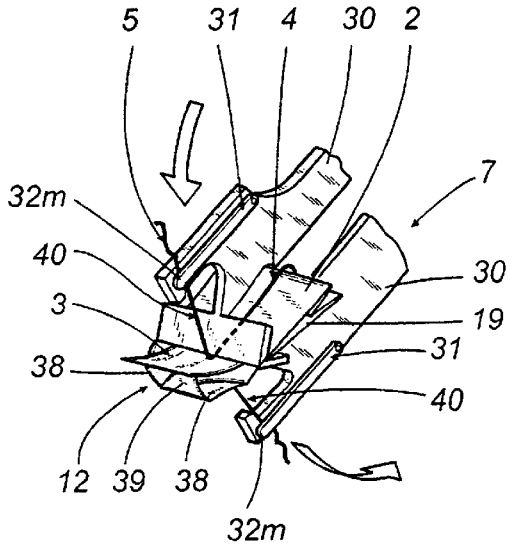

FIG.4
FIG.4E
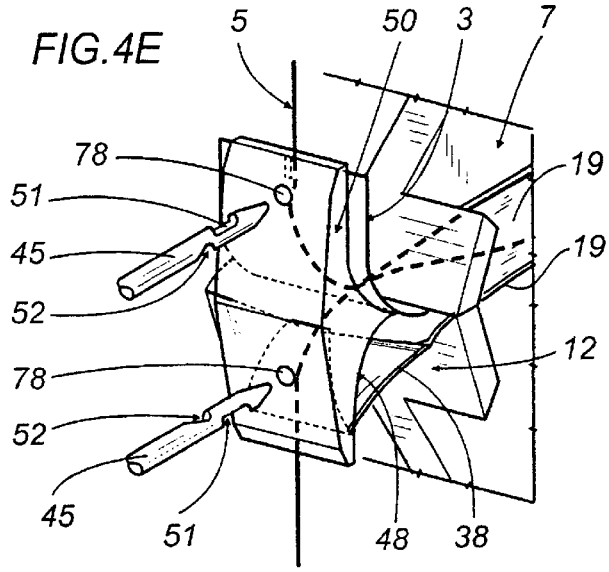
FIG.4E-1
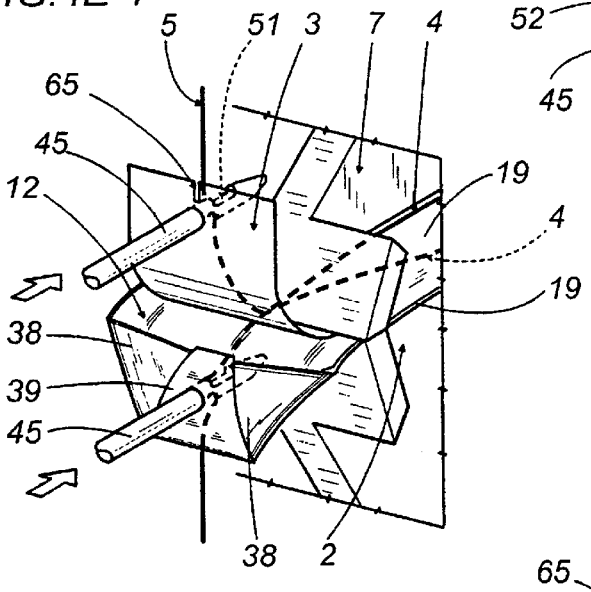
FIG.4E-2
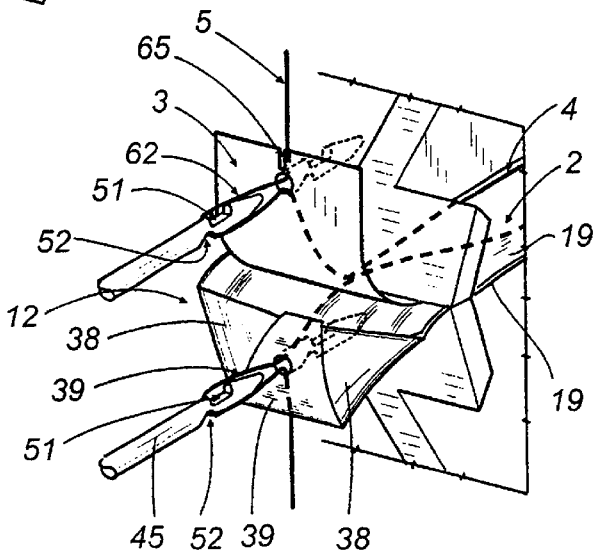

FIG.5
FIG.5E-5
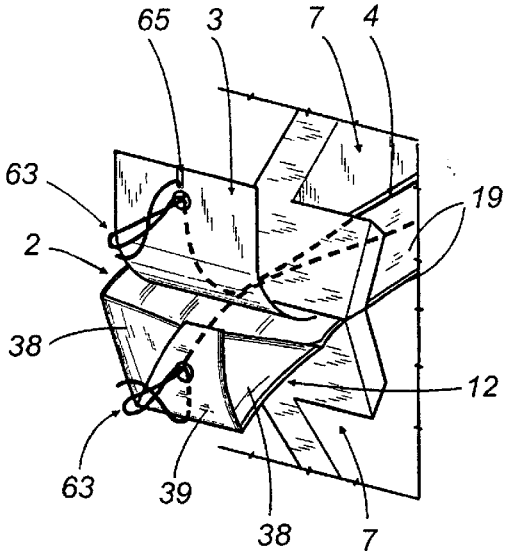
FIG.5E-6
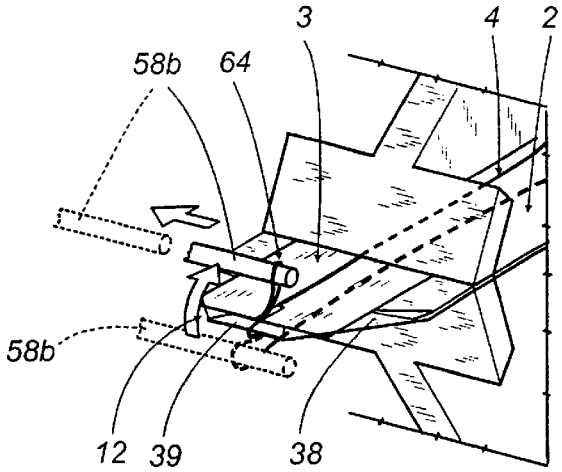
FIG.5F
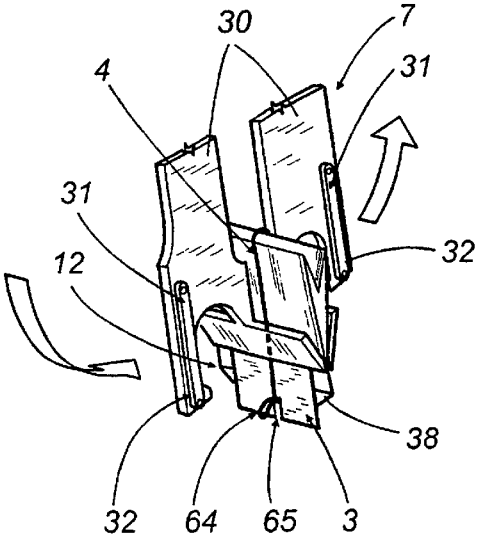
FIG.5G
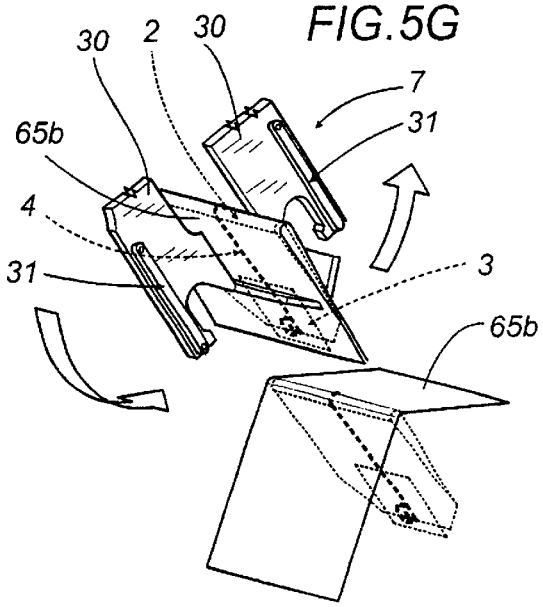

MACHINE FOR ATTACHING A TAG TO AN INFUSION BAG USING AN INTERMEDIATE KNOTTED THREAD

This application is the national phase of international application PCT/IB99/01550 filed Sep. 16, 1999 which designated the U.S.

TECHNICAL FIELD

The present invention relates to machines for the automatic production of filter bags containing a product for infusion, such as tea, camomile or other similar products, the filter bags being made of filter paper, folded and closed with a knotted thread which connects them to the pick-up tag.

BACKGROUND ART

In the packaging of products for infusion, the technique in which folded bags are formed and closed by knotting the thread connecting the filter bag and the pick-up tag is currently used to obtain top-quality bags of product, distinguished from similar bags by the fact that they prevent contact between the infusion and elements of the packaging which may, even to a limited degree, damage the health or (particularly important from a marketing viewpoint) modify the organoleptic characteristics of the infusion. Such effects are encountered, for example, in bags obtained by gluing sheets of filter paper with a hot-melt glue or even in bags in which the top is closed and the thread secured by metal staples.

DISCLOSURE OF THE INVENTION

In particular, the present invention relates to an improved machine of the type comprising a wheel which rotates with a stepping motion about its own axis of rotation and is equipped with grippers which, as the wheel rotates, are brought into contact with a series of operating stations around the wheel, which comprise, in particular, a station for folding a tubular semi-finished product consisting of filter paper containing the dosed product, and at least one station for knotting the thread so as to close the top of the bag and attach the pick-up tag to it. Such a machine is described in the application for an Italian patent BO95A000148.

A machine of the above-mentioned type fulfils the aim of allowing high-quality bags to be obtained. However, it can be significantly improved in terms of increasing its productivity.

The aim of the present invention is, therefore, to increase the production capacity of the machine through a corresponding increase in its operating speed.

Such an aim can be achieved by ensuring that the thread fed around the wheel, between the wheel and the operating stations, is not allowed to slide in an uncontrolled manner inside the machine, sliding which must be avoided, above all, during folding of the tubular section, when the thread is tensioned so as to circumscribe the filter bag being formed.

In accordance with the present invention, said aim is fulfilled by an improved machine comprising thread feed means which operate on the thread fed between pairs of grippers positioned one after another along the edge of the wheel.

If the machine, in accordance within a preferred embodiment comprises a knotting station equipped with a knotting device that has needles for knotting the thread to the tag and to the top of the filter bag, the needles being brought into contact with tag and bag-top stops and with respective mobile needle interceptor elements, the same aim can also be achieved by creating, in the knotting stations, between the needle, thread and interceptor elements, reciprocal connection conditions predetermined by precise geometric constraints which allow the obtainment of conditions which can be repeated with great precision, even when the machine is operating at high speed.

In accordance with the invention, the operating speed is increased by an improved machine in which the knotting device is equipped with at least one needle having a first and a second eye located at different distances from the point. Said needle, or needles being moved in such a way as to pick up the thread with the second eye, forming a loop in which the thread is associated with the first eye, an interceptor element being moved in time with the needle so that it passes through the first eye, pushing a section of thread through the above-mentioned loop.

In accordance with the invention, the above-mentioned aim is also achieved using a method for knotting the thread to the tag and to the top of the bag.

The technical features of the present invention, in accordance with the above-mentioned aims, are set out in the claims herein and the advantages more clearly illustrated in the detailed description which follows, with reference to the accompanying drawings, which illustrate a preferred embodiment without limiting the scope of application, and in which:

Figures 2, 2A:
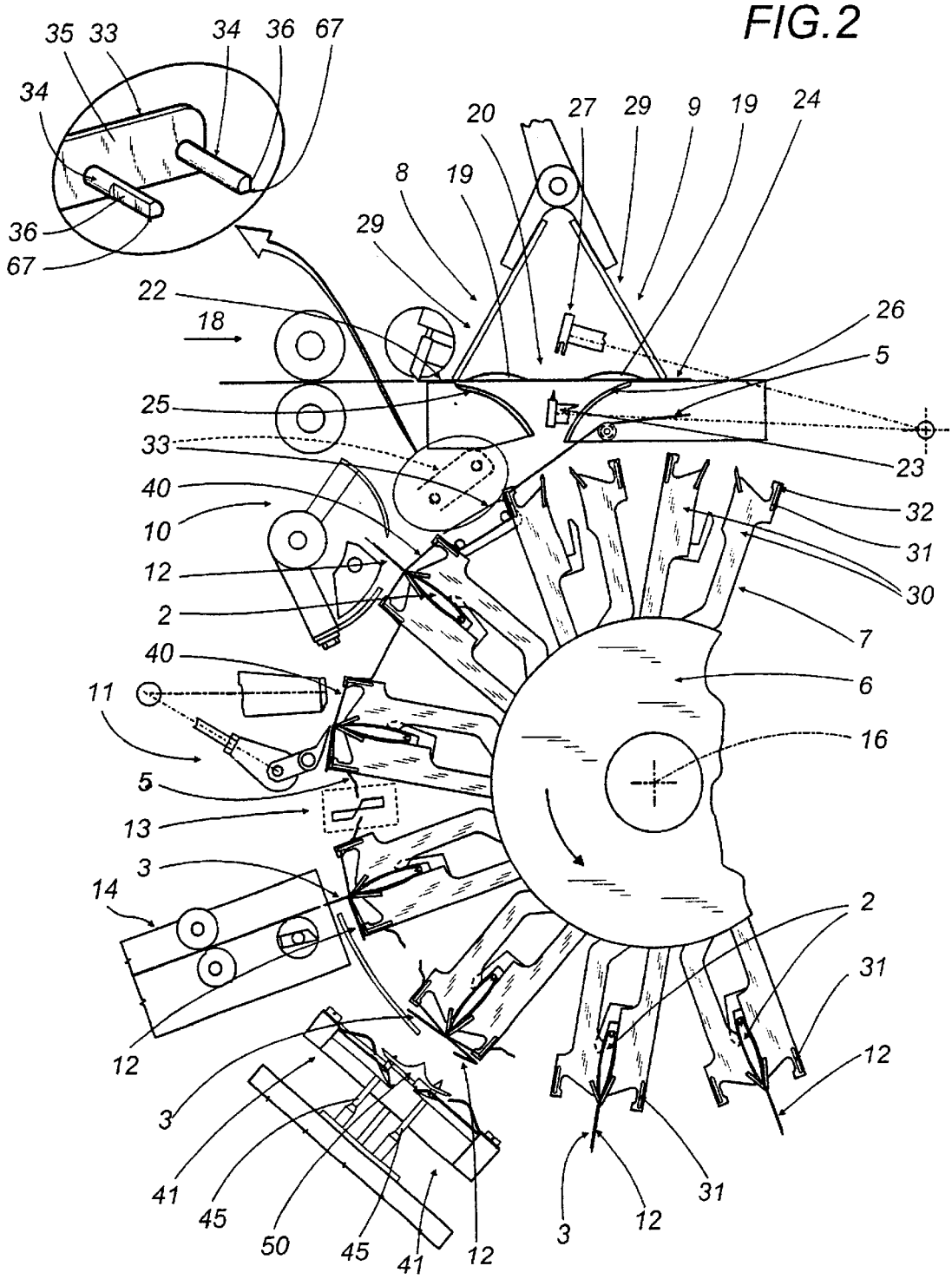
FIG. 2 is a partial, scaled up view of the machine in FIG. 1, with some parts cut away to better illustrate others.
Figures 3, 4E:
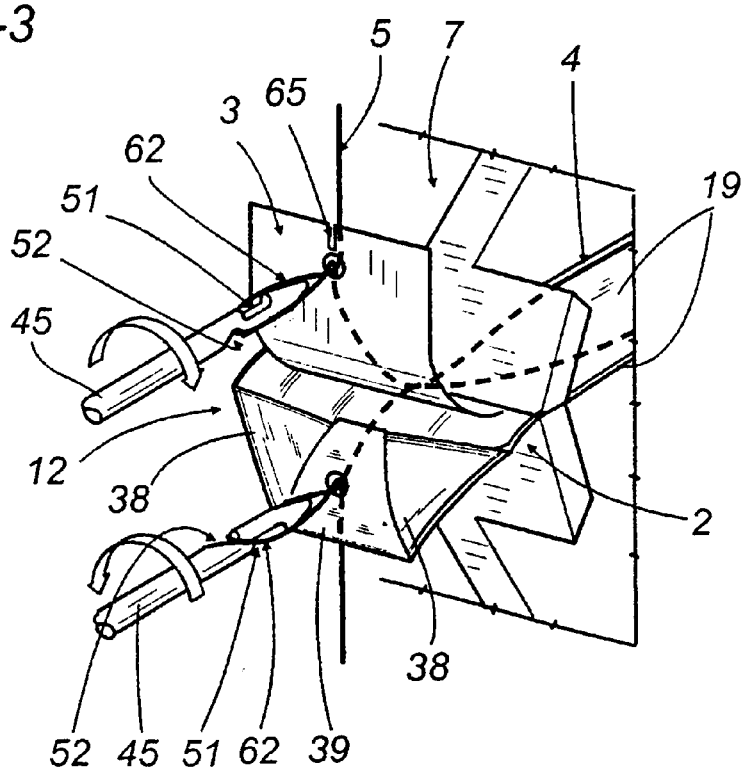
Figures 4, 4E:
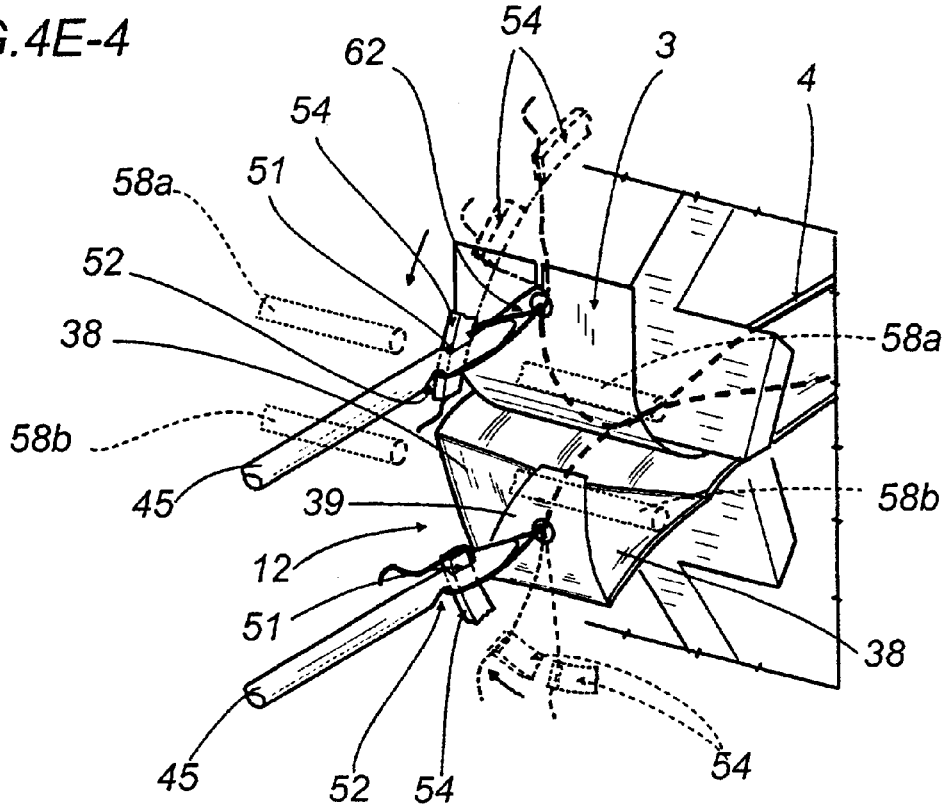
Figure 6:
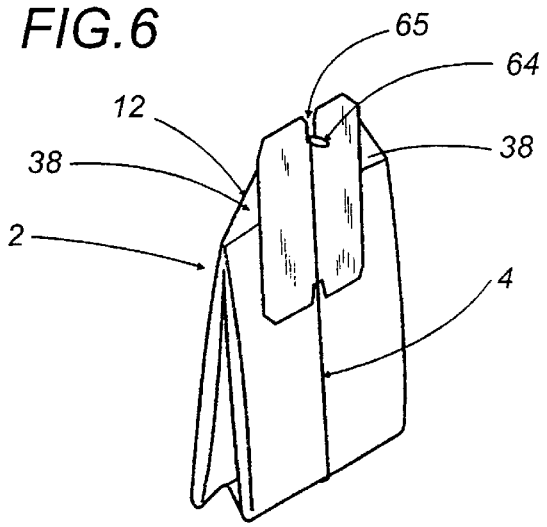
Figure 7:
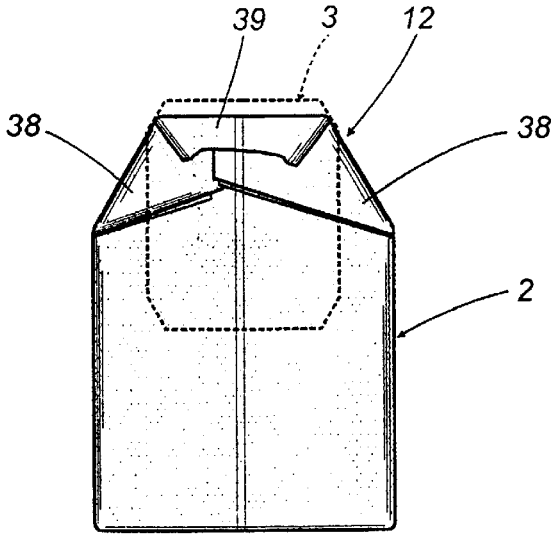
Figure 7A:
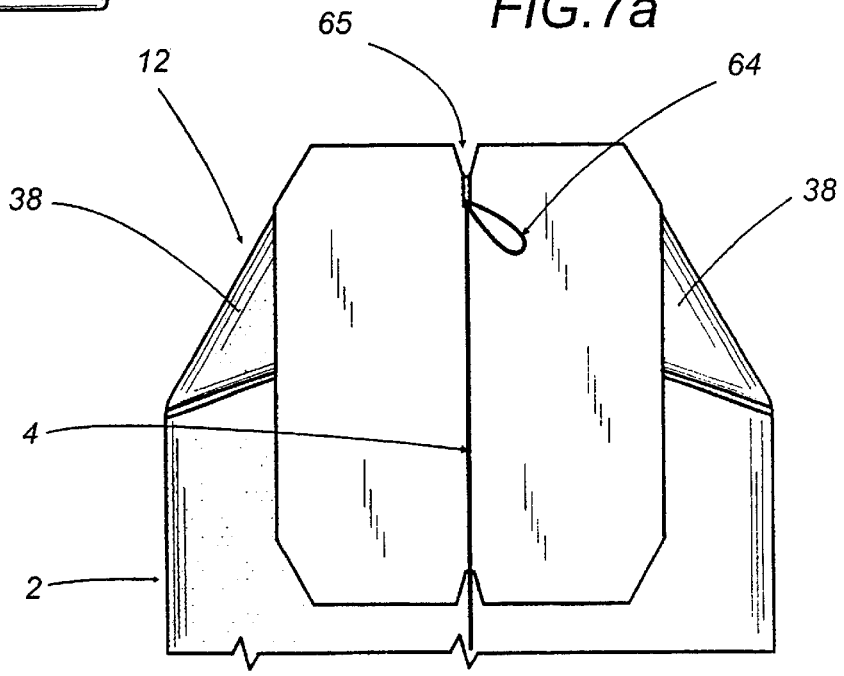
Figure 8:
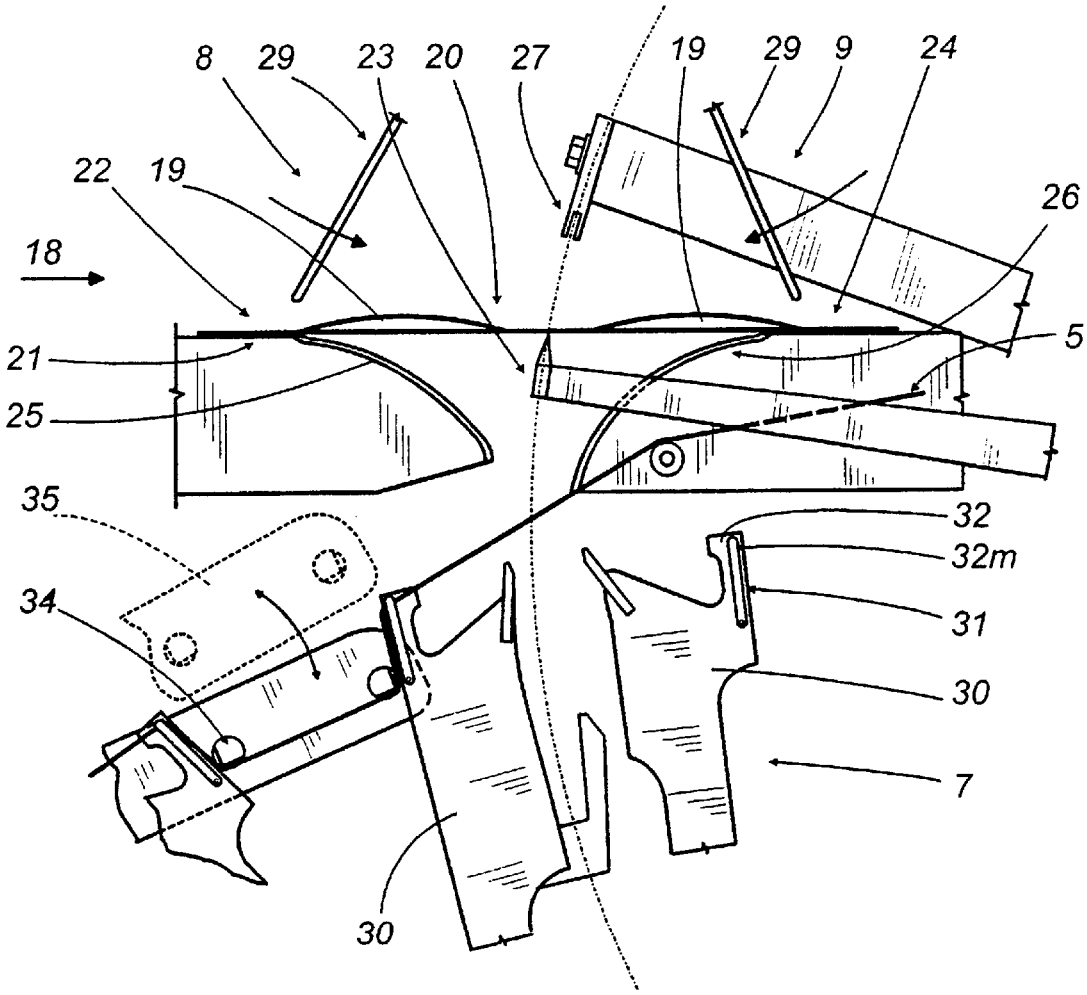
Figure 9:
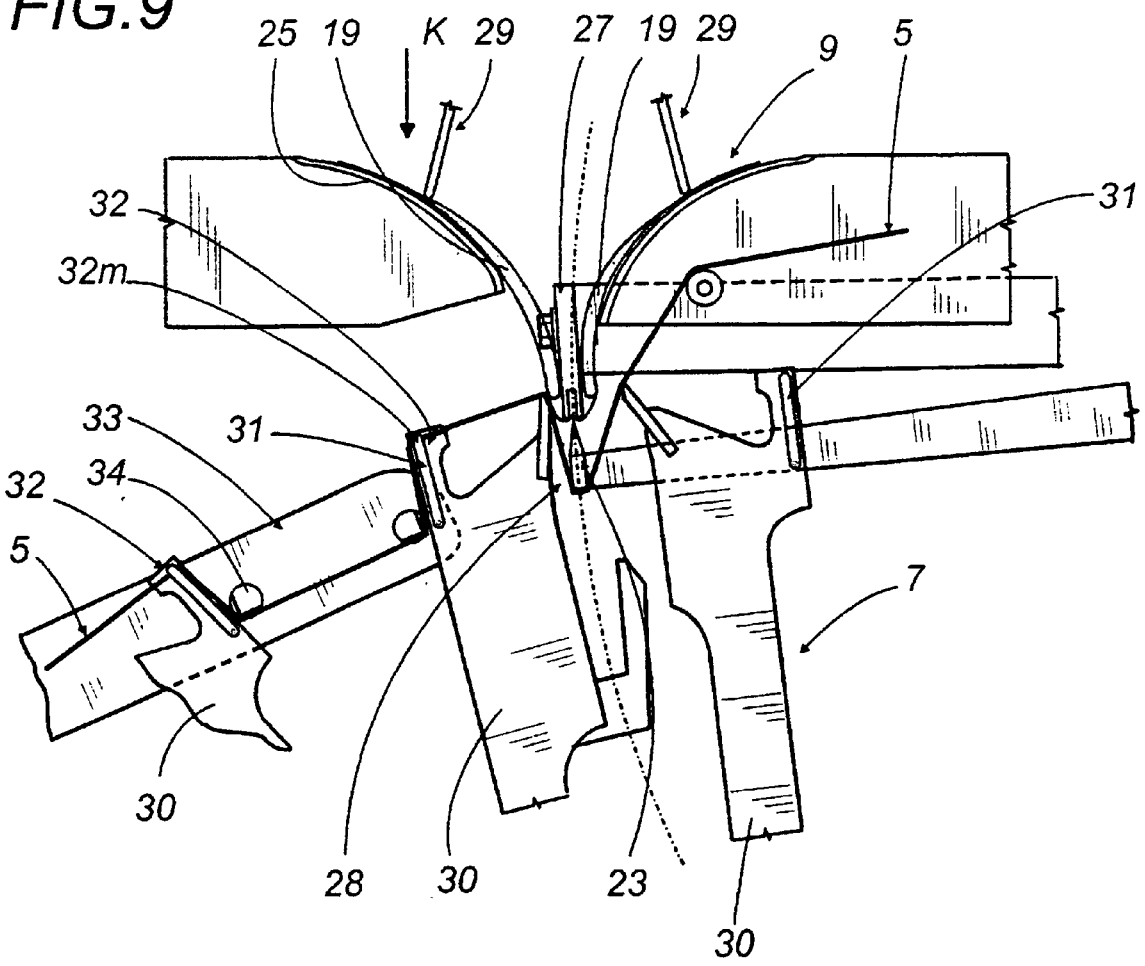
Figure 9A:
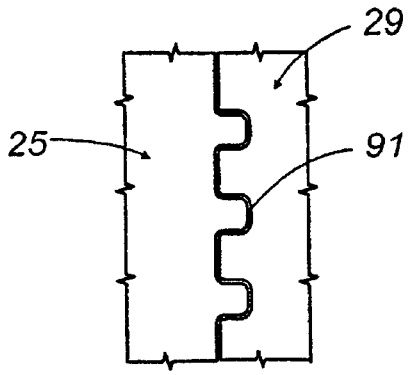
Figure 10:
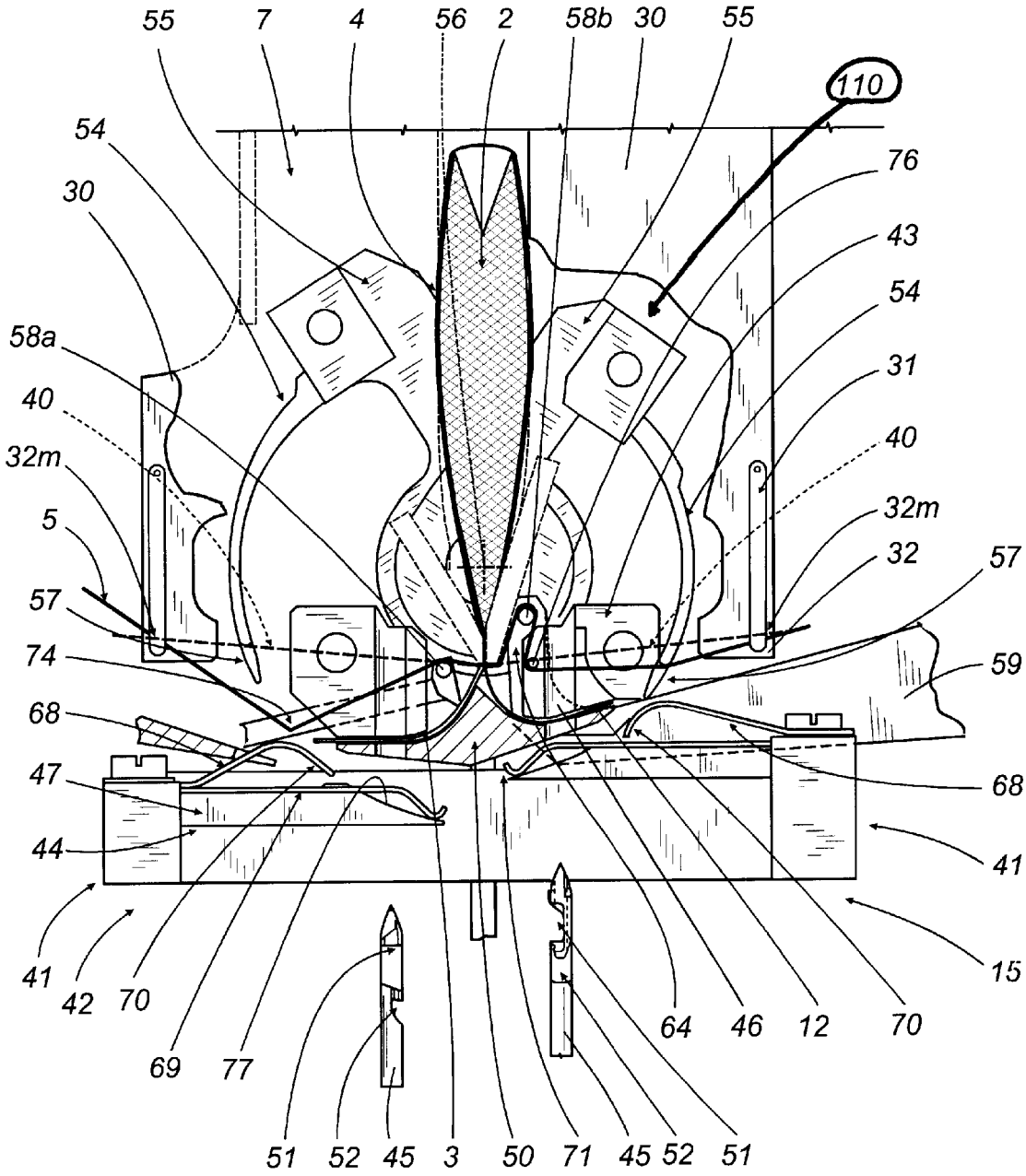
Figure 12:
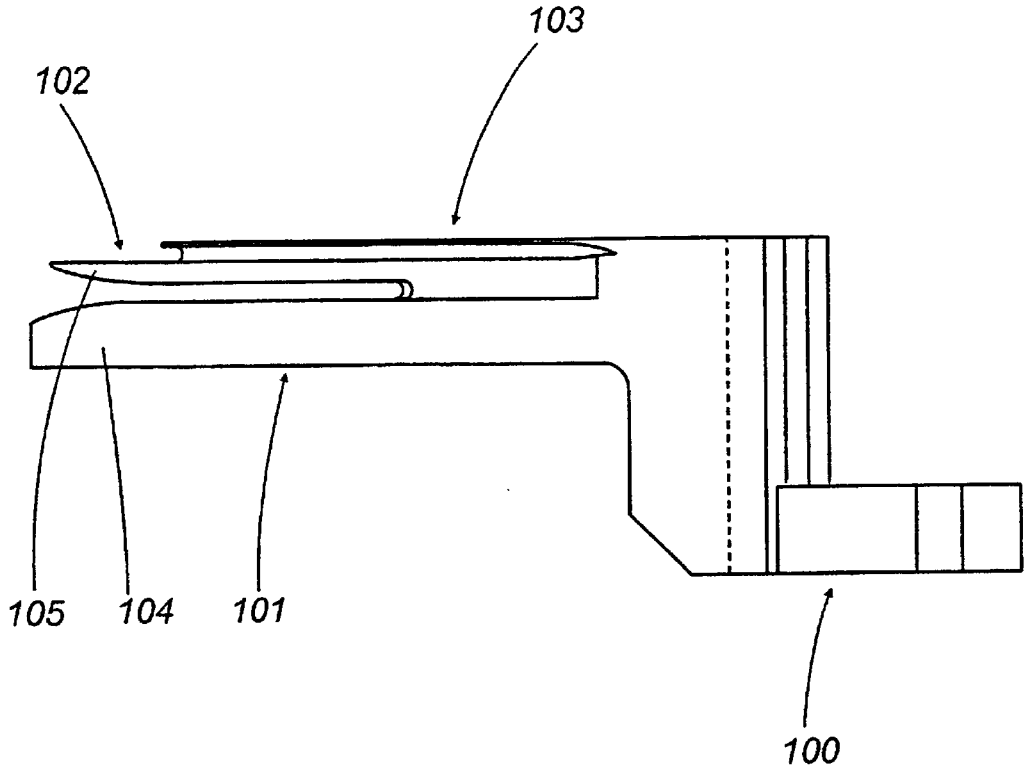
Figure 13:
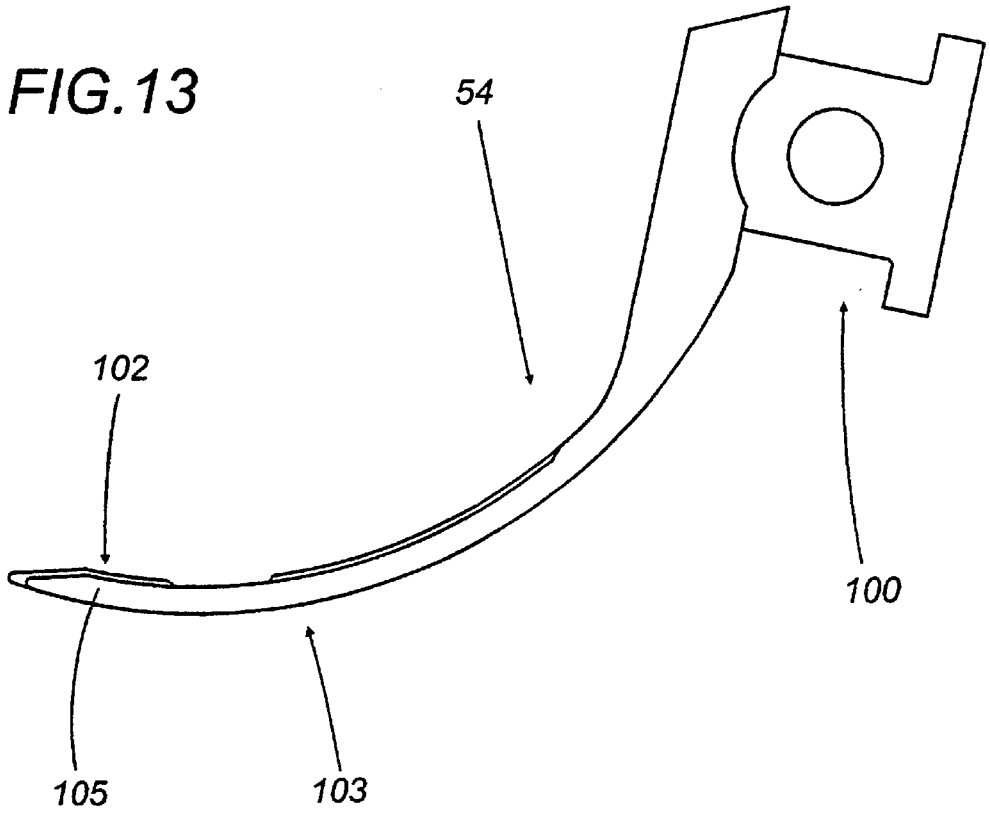

FIG. 2*a* illustrates a detail from FIG. 2;

FIGS. 3, 4 and 5 are schematic illustrations of a characteristic succession of operating stages of the machine according to the present invention;

FIGS. 6, 7 and 7*a* are a perspective assembly view, an elevation view and a scaled up detail of a filter bag made in the machine disclosed;

FIGS. 8, 9 and 9*a* are scaled up details of the machine, showing parts of the folding station in two elevation views (FIGS. 8 and 9) and a view from direction k in FIG. 9;

FIG. 10 is a scaled up detail view of the machine showing parts of the knotting station;

FIGS. 11 and 11A to 11M are detail views showing a succession of operating configurations of parts of the knotting station;

FIG. 12 is a plan view from below of an alternative embodiment of a detail of the invention;

FIG. 13 is a side elevation view of the detail illustrated in FIG. 12.

With reference to the accompanying drawings, the present invention relates to an improved machine 1 (see FIG. 1) for packaging a product for infusion in filter bags 2, made of folded filter paper (see FIGS. 6, 7 and 7*a*), with a pick-up tag 3 tied to the filter bag 2 by a section 4 of thread 5 knotted at both ends, at one end to the filter bag 2 and at the other to the pickup tag 3. The thread 5 not only corrects the tag 3 and the filter bag 2, but also connects the tag 3 to the filter bag 2 in such a way that it can be removed, by a loop 62 made in the thread 5, engaged in the pick-up tag 3 and operating as described below.

The machine 1 has a wheel 6 (see FIG. 2) with a plurality of substantially radial grippers 7 at its edge. The wheel is surrounded by a series of operating stations respectively called the: semi-finished product reception station 8; semi-finished product folding station 9; first and second stations 10, 11 for forming the top 12 of a filter bag 2; thread 5 cutting station 13; tag 3 feed station 14; knotting station 15.

The wheel 6, driven in such a way that it rotates, with angular steps, in one direction only about its axis of symmetry 16, gradually interacts with each of the operating stations until the finished product is obtained (filter bags 2 with relative pick-up tag 3 and connecting thread 5 wound around the filter bag 2 and held by the tag 3 by means of the loop 62 in the thread 5 inserted in a notch 65 in the tag 3—see FIGS. 6, 7 and 7*a*) from a semi-finished product 20 prepared in a part 17 of the machine 1 located upstream of the reception station 8, using methods which are not described or illustrated in the present application for a patent, since they are not part of the subject matter of the present invention.

Specifically, in the reception station 8, the machine 1 receives in the direction of feed 18, substantially at a tangent to the wheel 6, the semi-finished products consisting of straight, extended tubular semi-finished product 20 of filter paper, said semi-finished products: obtained by folding the sheets of filter paper (fed from reels 20*n*); being open at both ends; and containing two doses 19 of a product for infusion, suitably spaced along the direction of feed 18. In this case, reference is made to the manufacture of the classic two-lobed filter bag.

The reception station 8 is equipped with a virtual reception table 21 for the tubular semi-finished product 20, defined by three consecutive support surfaces 22, 23 and 24 (see FIGS. 8 and 9).

Two support surfaces 22, 24 are fixed and positioned one after the other at a tangent to the direction of feed 18, so that they support the two ends of the tubular semi-finished product 20. The third support surface 23, located between the other two, is mobile across the direction of feed 18 of the tubular semi-finished product 20, synchronised with the tubular semi-finished product 20 feed, so that it is aligned with the fixed support surfaces 22, 24 immediately before the tubular semi-finished product 20 arrive at the reception station 8.

Attached to the reception station 8, the machine 1 includes the tubular semi-finished product 20 folding station 9. The latter has two continuous walls 25, 26, the ends of which incorporate the fixed support surfaces 22, 24 of the reception station 8 and which extend in such a way that they gradually converge towards a zone close to the edge of the wheel 6. It also has a gripper element 27, located opposite the mobile support surface 23 and, relative to the tubular semi-finished product 20, on the side opposite that which makes contact with the mobile support surface.

The gripper element 27 and the mobile support surface 23 have matching operating ends, shaped in such a way that when they are clamped together in a zone located between the opposite ends of the tubular semi-finished product 20, they form a "W"-shaped fold 28 which separates two separate lobes in the filter bag 2. The gripper element 27 and the mobile support surface 23 can also move together between the walls 25, 26, both towards and away from the wheel 6.

The folding station 9 also comprises two mobile pressure pads 29 with operating ends (FIG. 9*a*) shaped in such a way that they fit into a matching shape in the fixed walls 25, 26, defining a space 91 between them in which the open opposite ends of the tubular semi-finished product 20 containing the product for infusion are clamped in such a way as to prevent the product 19 from escaping. Said pressure pads 29 are mobile, synchronised with the motion of the gripper element 27 and the mobile support surface 23 opposite it.

In the folding station 9, each tubular semi-finished product 20 (see FIG. 3A), after being received onto the support surfaces 22, 23, 24, is first clamped between the mobile central support surface 23 and the gripper element 27 to form the "W"-shaped fold 28, then transferred between the open teeth 30 of a gripper 7 which has moved to the folding station 9. During said transfer, the tubular semi-finished product 20, initially in a linear configuration, is gradually positioned at an angle, with the lobes of the filter bag 2 folded against one another (see FIG. 3B). In passing from the initial condition to the final condition, the opposite ends of the tubular semi-finished product 20 slide along the fixed walls 25, 26, clamped between the latter and the pressure pads 29 so that they remain closed, as already indicated, preventing the product in the filter bag 2 from escaping.

As illustrated in FIG. 2, the thread 5 for connecting the tag 3 to the filter bag 2 is fed continuously between the folding station 9 and the wheel 6. The thread is supported opposite the station by the teeth 30 of the various grippers 7, by support elements labelled 31 as a whole, which are attached to the wheel 6 on both sides of the grippers 7, are supported by the teeth 30 and comprise lateral projections 32 of the gripper 7 which project towards the thread 5.

The thread 5 support elements 31 comprise friction surfaces set opposite one another and elastically separated by a spring element 32*m* which, in a preferred embodiment, consists of a leaf spring made of an elastic, flexible plate, attached to the projection 32 in such a way that it is subject to elastic deformation, when bent, and constantly presses against the projection 32. The thread 5 is held, by friction, between the opposite friction surfaces of the plate and the projection 32 and, although free to slide tangentially to the friction surfaces due to the drawing motion imparted to it by the rotation of the wheel 6 which unwinds it from a reel 37, it remains constantly taut between the consecutive support elements 31 of a gripper 7.

Between the gripper 7 at the folding station 9 and the gripper located in the next, adjacent position, according to the direction of rotation of the wheel 6 (position corresponding with the first forming station 10), the machine 1 has thread 5 feed means which comprise (FIG. 2*a*) a fork 33, with extended teeth 34, which are angled parallel with the axis of rotation 16 of the wheel 6 and supported, projecting horizontally, by an arm 35 which oscillates in the vertical plane between a home position, in which the teeth 34 are located outside the edge of the wheel 6, and an operating position, in which the teeth 34 are located within the edge of the wheel 6, between two consecutive grippers 7 on the wheel.

The teeth 34 have flat lateral faces 36 which meet at vertices 67 respectively adjacent to two consecutive grippers 7 on the wheel 6. When the arm 35 oscillates, bringing the teeth 34 from the home position to the operating position within the wheel 6, the teeth 34 intercept the thread 5 located between the support elements 31 of two consecutive grippers 7 and give it a segmented configuration, in which there are alternate sections of thread 5 in directions preferably corresponding to the radius and a chord of the wheel 6. This configuration allows considerable lengthening of the thread 5 subjected to the holding action implemented by the friction surfaces of the support elements 31, the faces 36 and vertices 67.

The interaction of the thread 5 with the folding station 9 is also illustrated in FIGS. 8 and 9. In particular, both indicate that, during folding of a tubular section 20, the thread 5 being unwound from the feed reel 37, remaining taut between the support elements 31 on the open teeth 30 of the gripper 7 (which has moved into position below the folding station 9) and also being held taut by the presence of the feed means 33, 34 which stop it from sliding backwards, is intercepted by the mobile support surface 23 (located between the tubular section 20 and the wheel 6) and is unwound from the reel 37 while being drawn through the teeth 30 of the gripper 7 and wound around the edge of the filter bag 2.

Since the mobile support surface 23 consists of two elements with reciprocal penetration, parallel with the axis of rotation 16 of the wheel 6, and mobile relative to one another, controlling the disengagement of the two elements, the mobile support surface 23 is detached from the wheel 6 by the translation of at least one of the two elements, effected according to the axis of rotation 16. The support surface 23 then returns towards the reception station 8, whilst the wheel 6 is moved forward towards the first forming station 10 for the top 12 of the filter bag 2, with the filter bag 2 clamped between the closed teeth 30 of the gripper 7 (FIG. 3B).

In the first forming station 10, two side folds 38 of the top 12 are formed (see FIGS. 3B and 7), by interception, in the known manner, with fixed stop elements located on the outside of the wheel 6.

In the second forming-station 11, reached when the wheel 6 has moved another angular step, the above-mentioned side folds 38 are folded over themselves again by the formation of a third, central fold 39 (see FIGS. 3C and 7), again using known stop elements which are not illustrated.

At the outfeed of the second forming station 11, the top 12 of the filter bag 2 forms an angle of around 90° to the rest of the filter bag 2 held in the gripper 7 and is angled forwards, according to the direction of rotation of the wheel 6. As regards the thread 5, it should be noticed that, in the current situation, it is held taut by the support elements 31 on either side of the gripper 7 (projections 32 and springs 32*m*) and by the relative teeth 30. Moreover, a substantially straight section of thread along a chord of the wheel 6 and between the gripper 7, below in the second forming station 11, and the next, adjacent gripper 7, according to the direction of rotation of the wheel 6 (see FIG. 2), passes through the cutting station 13.

The cutting station 13 is activated before the gripper 7, standing by in the second forming station 11, is moved forward towards the tag 3 feed station 14. Thus, when the above-mentioned gripper 7 reaches the tag 3 feed station 14, the filter bag 2 is surrounded by a section 4 of thread with lengths 40 held taut between the spring elements 32*m* and the teeth 30, which is separated from the uninterrupted thread 5 still attached to the grippers 7 which follow on the wheel 6.

In the tag 3 feed station 14, the gripper 7 is slightly opened and immediately closed again, so that its teeth 30 grip one end of the tag 3, which is held tightly against the filter bag 2 (see FIG. 3D).

Briefly, at the tag 3 feed station 14 outfeed, the filter bag 2 is held between the closed teeth 30 of the gripper 7; the top 12 of the filter bag 2 is folded forward relative to the direction of rotation of the wheel 6; the tag 3 is folded back and the section 4 of thread 5, wrapped around the filter bag 2 and held by the gripper 7, has two lengths 40 which exit the gripper 7 and are held taut between the two teeth 30 of the gripper 7 and the adjacent spring elements 32*m*, on the lateral projections 32.

The knotting station 15 comprises a knotting device 42 (FIGS. 10, 11) with two operating heads 41 which are positioned on either side of the filter bag 2 when the wheel 6 stops and which, in particular, simultaneously connect the section 4 of thread 5 to the tag 3 on one side, and to the top 12 of the filter bag 2 on the other.

Figures 11, 11A:
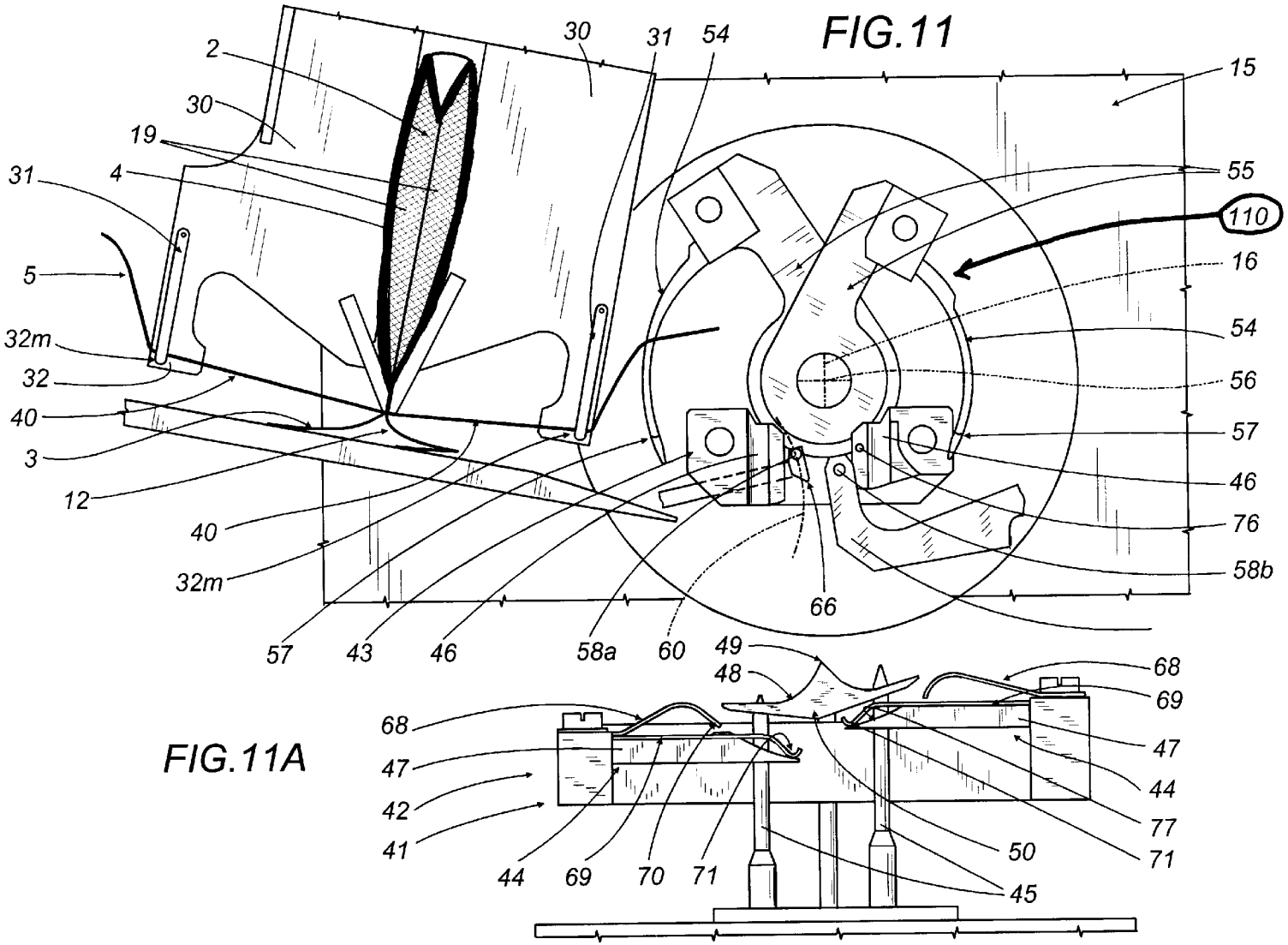

With reference to FIGS. 10 and 11, from A to I, it can be seen that each of the operating heads 41 of the knotting device 42 comprises a stop 43 for the tag 3 (or for the top 12 of the filter bag 2, depending which operating head 41 is considered), a presser body 50, a pressure pad 44, a needle 45, thread 5 positioning means, means 110 for threading the thread 5 and means for straightening the tag 3 and the top 12 of the filter bag 2, respectively labeled 58*a* and 58*b*.

The stops 43 are preferably integral with one another, in a single block and, in particular, each one has a longitudinal cavity 46 passing through it, or an equivalent groove with an open side, which is straight and shaped in such a way that it matches the shape of the needles 45. These stops 43 are mobile, across the plane in which the wheel 6 lies, between a first, operating position, in which one of them is in contact with the tag 3 whilst the other is in contact with the top 12 of the filter bag 2, and a home position in which said stops 43 are moved parallel with the axis of rotation 16 of the wheel 6, in a position designed not to interfere with the rotation of the wheel 6.

The presser body 50 (preferably a single body for the tag 3 and the top 12 of the filter bag 2) is positioned between the wheel 6 and the pressure pads 44 and is mobile, in a direction radial to the wheel 6, between a home position in which it is as far away as possible from the edge of the wheel 6, and an operating position in which it is as close as possible and is positioned next to the stop element 43. Moreover, it has two curved contact surfaces 48 which make contact with the tag 3 and the top 12 of the filter bag 2, said surfaces coming together at a point 49, substantially aligned with the axis of the gripper 7 standing by in the knotting station 15 and designed to insert itself between the tag 3 and the top 12 of the filter bag 2, holding them apart when it is in the position in which it is as close as possible to the wheel (see FIGS. 4E-4E-1 and FIGS. 10 and 11). The curved surfaces 48 are asymmetrical and at different distances from the axis of rotation 16 of the wheel 6. This feature allows the thread 5 to be knotted at points of the tag 3 and the top 12 of the filter bag which are at different distances from the ends of the gripper 7 teeth 30, allowing the top 12 of the filter bag 2 to be tied in such a way that a single knot ties off all three folds 38 and 39 on the top 12 (see FIG. 7).

Each pressure pad 44 comprises a support body 47, in which there are through-holes 72 for the needles 45, aligned with the longitudinal cavity 46 in the stop elements 43 above, and with the holes 78 in the presser body 50. Connected to the support body 47, there are two elastic plates 68, 69, with offset connection, which project end sections 70 and 71 towards the needles 45 at the relative free ends.

The pressure pads 44 are mobile, suitably synchronised with the machine 1 operating cycle, between an operating position, in which the presser body 50 is in contact with the tag 3 and the top 12 of the filter bag 2, in contact with the stop elements 43, and a home position, in which they are positioned away from the wheel 6, so that they do not interfere with the rotation of the wheel 6. Each needle 45 (FIGS. 4, 10 and 11) has a first and a second eye 51, 52, located at different distances from the point. The eyes 51, 52 are positioned on the edge of the needles 45, have an open side and are angled in such a way that they cover two transversal planes of the needle 45, passing through the longitudinal axis of the needle 45 and set at right angles to one another. Each needle 45 is also mobile, being able to move in both directions along its longitudinal axis and to rotate about said axis (see FIGS. 4E, 1–4).

The thread 5 positioning means comprise the gripper 7 teeth 30, the adjacent projections 32 and the leaf spring elements 32*m*. FIGS. 3 and 10 show how each length 40 of the thread (shown as a dashed line) which exits the closed teeth 30 of the gripper 7 is taut, in a well-defined position between the teeth 30 and the support elements 31, being positioned, as is explained below, on one side, in front of the longitudinal cavity 46 in the tag 3 stop element 43, and on the other side, in front of the corresponding cavity 46 in the stop element 43 for the top 12 of the filter bag 2.

The threading means 110 comprise two curved interceptor elements 54, in the shape of a circular arc (one for each of the operating heads 41), on a relative arm 55 which rotates about a centre of rotation 56 which substantially coincides with the centre of curvature of the respective interceptor element 54.

Each interceptor element 54 is moved by relative drive means, not illustrated, in such a way that it is moved from a home position, at the side of the length 40 of thread 5, to an operating position in which the free end 57 intercepts the length 40 of thread 5 and is inserted into the eye 51 of the needle 45 closest to the point (FIG. 4E-4), passing through it.

The tag 3 and filter bag 2 top 12 straightening means consist of pins 58*a*, 58*b* extending parallel with the axis of rotation 16 of the wheel 6 and moved by suitable drive means. One of the pins 58*a* has a pointed profile, forming an edge 66 designed to press the tag 3 against a first contact surface 48 on the presser body 50. The other pin 58*b* preferably has a cylindrical profile, is supported by a lever 59 and is designed to perform functions described below.

FIGS. 10 and 11 show how the pin 58*a* for the tag 3 is moved, by the relative drive means, parallel with itself, along a curved trajectory 60, substantially monotonic and delimited by two end positions, in one of which the pin 58*a* clamps the tag 3 against the presser body 50, contributing to the curve in the tag along the contact surface 48; the pin 58*a* reaching the second end position when the tag 3 is in a flat configuration, favoured by the forward movement of the pin 58*a* towards the presser body 50 which, in the meantime, moves back towards its home position.

In contrast, the pin 58*b* for the top 12 of the filter bag 2 has a complex curved trajectory 61 (FIG. 11M), having arcs with variable concavity, opposite one another along its length, for reasons which are explained in the description below.

Figure 1:
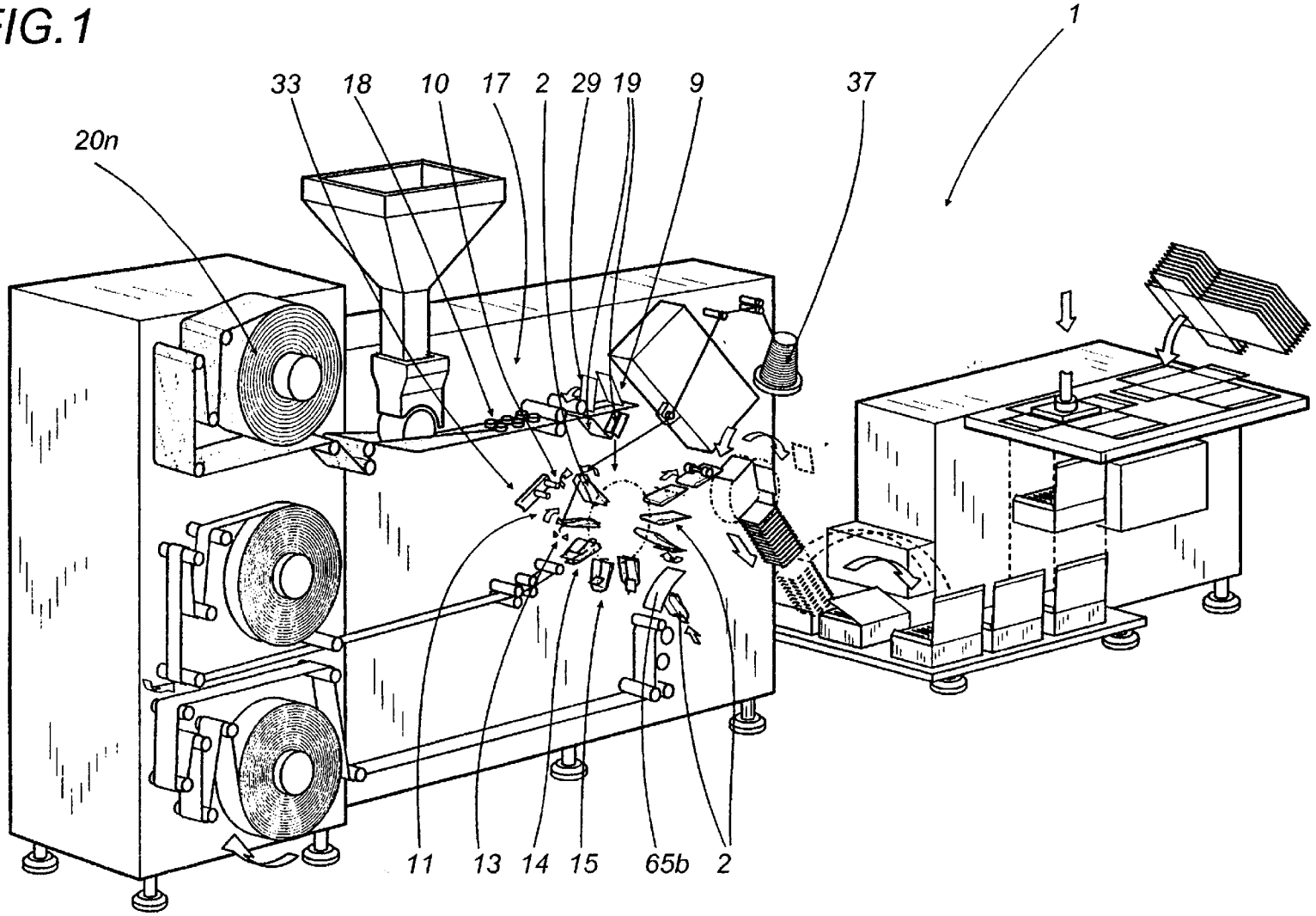
FIG. 1 is an assembly view of the improved machine according to the present invention.
Figure 11B:
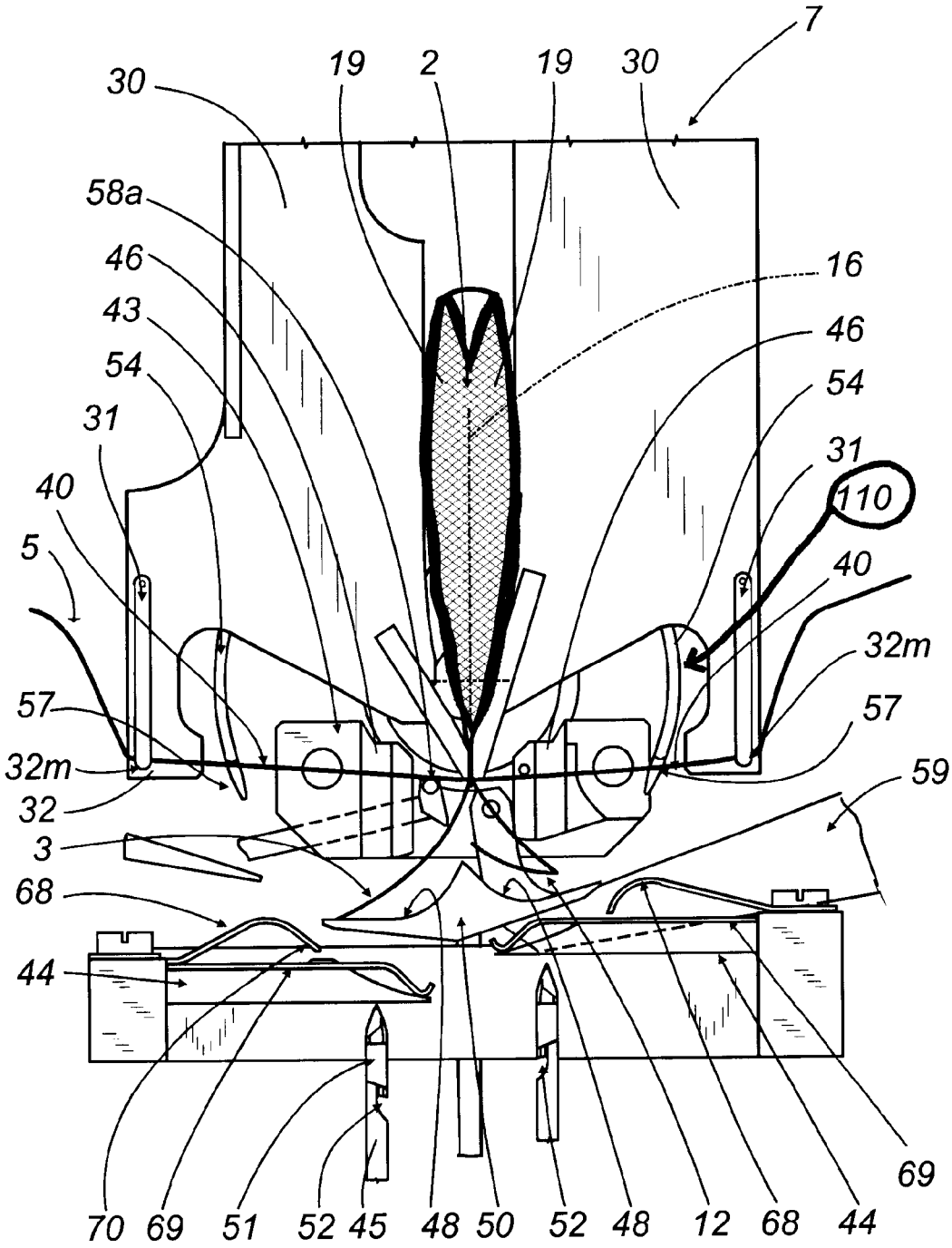

In practice, the operation of the knotting station 15 may be described with reference to the diagrams in FIGS. 4E-1/5E-6, and with the aid of FIGS. 10 and 11 starting from the initial condition in which: (FIG. 11A) the presser body 50 and pressure pads 44 are at the maximum distance from the edge of the wheel 6; the interceptor elements 54 are drawn back in their home position, their ends 57 at the maximum distance from the needles 45; the stop elements 43 and pins 58*a*, 58*b* are moved off the plane in which the wheel 6 lies, in a direction parallel with the axis of rotation 16 of the wheel, and in a position in which they do not interfere with its rotation, and the wheel 6 is moving a gripper 7 through the knotting station 15 towards a stand-by configuration in which the gripper 7 will stop with the ends of its teeth 30 clamped on the filter bag 2 and substantially aligned, in a direction radial to the wheel 6, with the tip 49 of the presser body 50 (FIG. 11B). In said starting condition, the lengths 40 of thread 5 (illustrated with a dashed line in FIG. 10) are held taut between the ends of the teeth 30 and the relative lateral projections 32 located respectively on the same side as the tag 3 and on the same side as the top 12 of the filter bag 2 (FIGS. 3D and 11A).

Figure 11C:
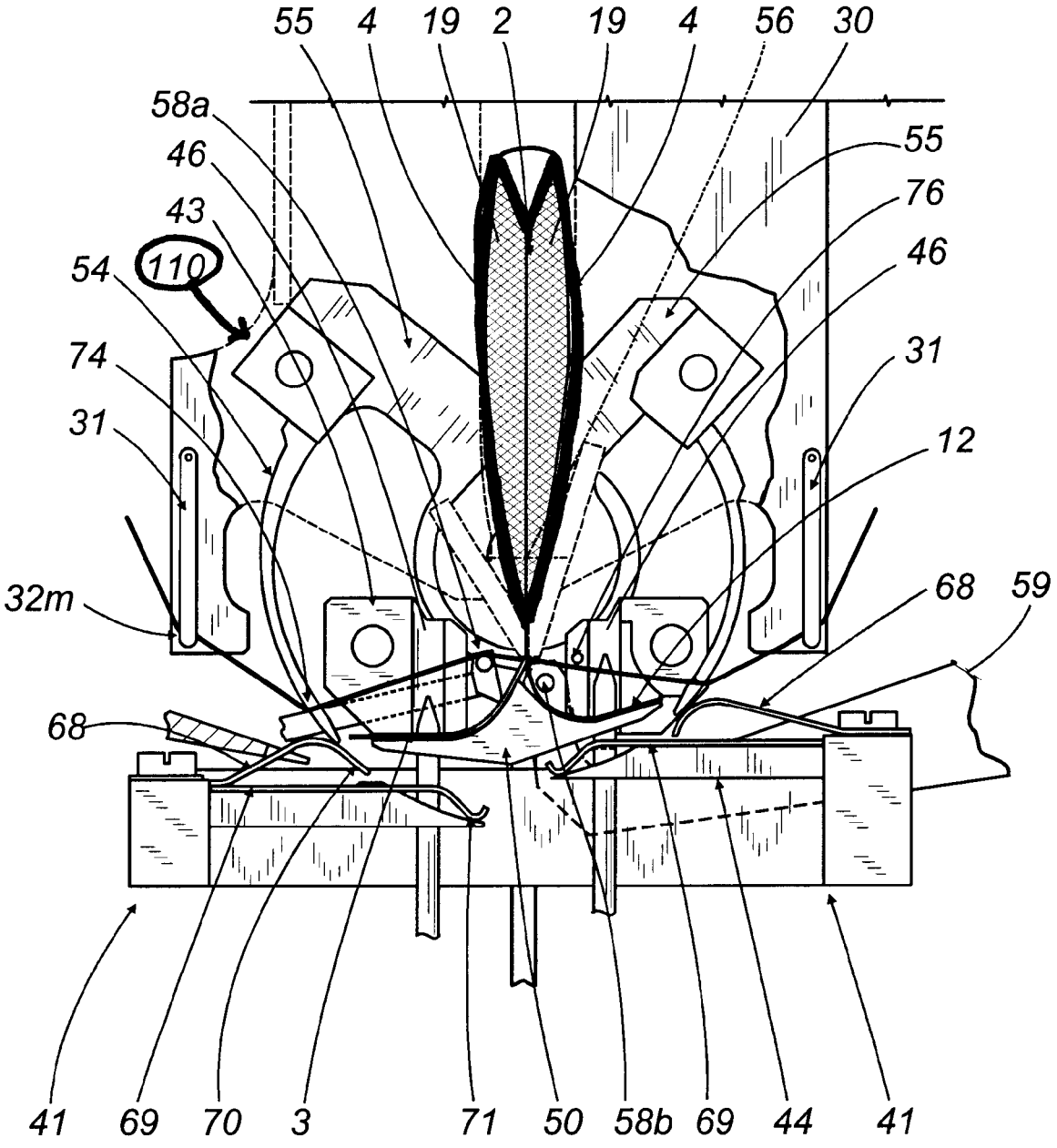

Starting from this overall configuration, the presser body 50 begins to move towards the position in which it is as close as possible to the wheel 6, positioning the tip 49 in the space between the tag 3 and the top 12 of the filter bag 2 (FIGS. 4E and 11B). While the presser body 50 moves over a given length of its stroke towards the position in which it is closest to the wheel, both the pressure pads 44 below and the extended pins 58*a*, 58*b* move forward parallel with the axis 16 of rotation of the wheel 6, being inserted, on one side of the gripper 7, between a length 40 of thread and the tag 3, and on the other side of the gripper 7, between the other length 40 of thread and the top 12 of the filter bag 2. During the final stage of the stroke towards the wheel, the presser body 50 (FIG. 11C), the top 12 of the filter bag 2 and the tag 3 rest on the contact surfaces 48 of the presser body 50, assuming a corresponding curve. This curve is imposed on the tag 3, made of a material which is more rigid than the filter bag 2, partly thanks to the pin 58*a* which interacts with the opposite surface 48 of the presser body 50 and simultaneously moves towards the wheel 6 so that the tag 3 is curved by adapting it to the contact surface 48. When the stops 43 have also reached their definitive operating position, while the pin 58*a* remains stationary for a brief interval; the pin 58*b* for the top 12 of the filter bag 2 is moved by the relative lever 59 away from the top 12 of the filter bag 2 and towards the centre of rotation 56 of the wheel 6 (FIG. 11C, right-hand side). While completing this movement, the pin 58*b* intercepts the length 40 of thread and, together with a projection 76 on the stop 43, forces the length of thread to form a small loop 64, illustrated with a continuous line in FIG. 10.

Figure 11D:
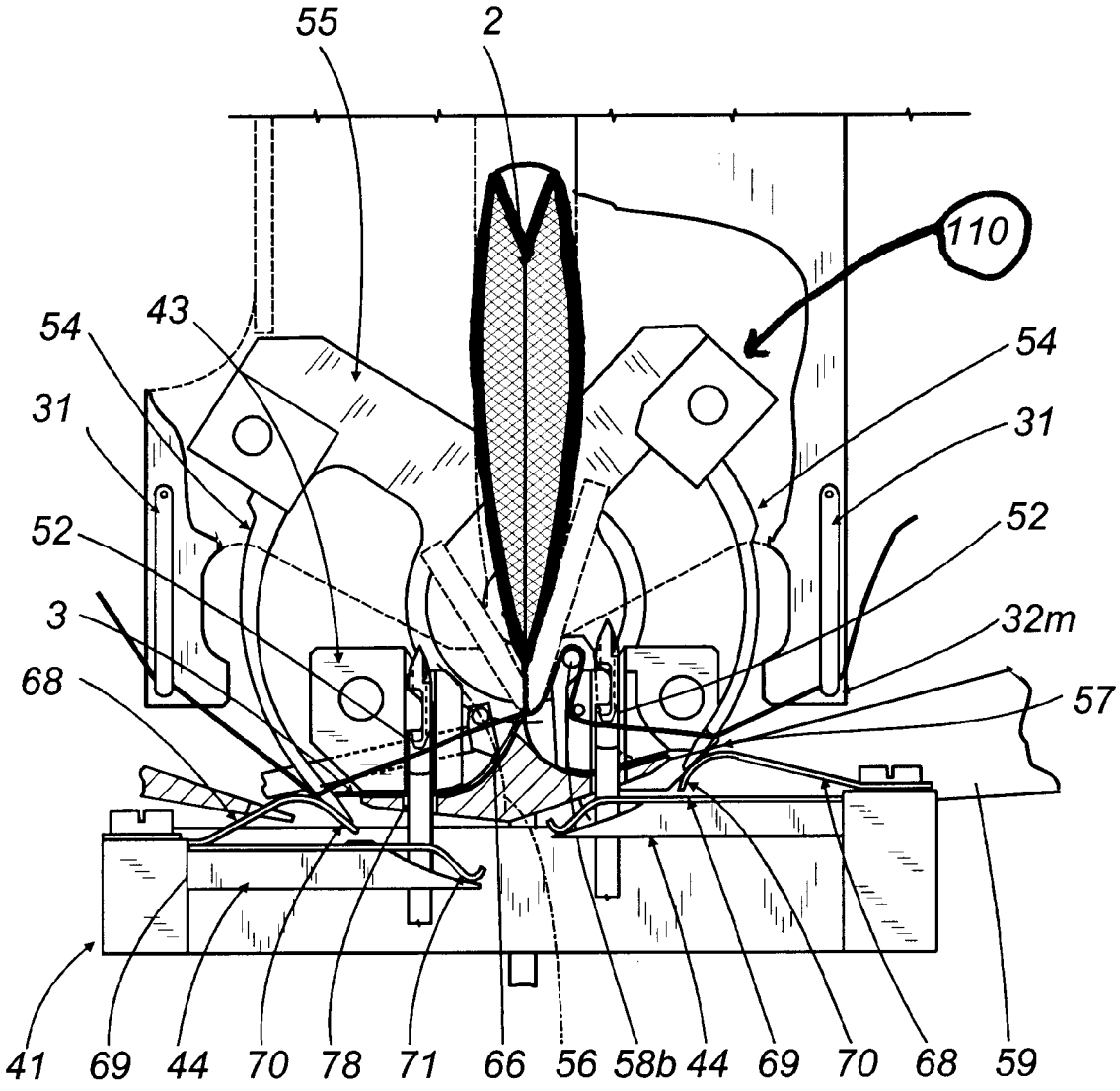
Figure 11E:
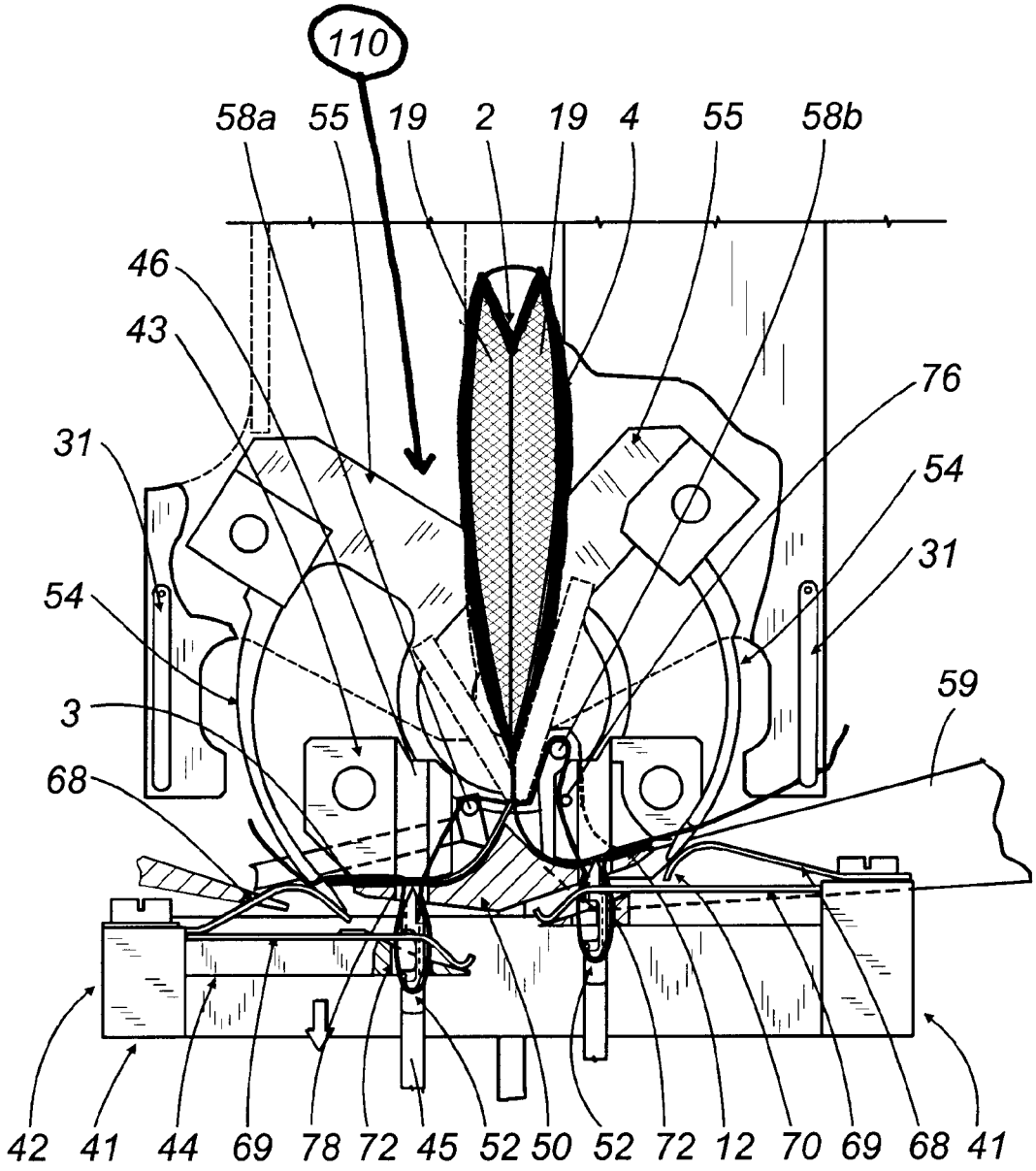
Figure 11F:
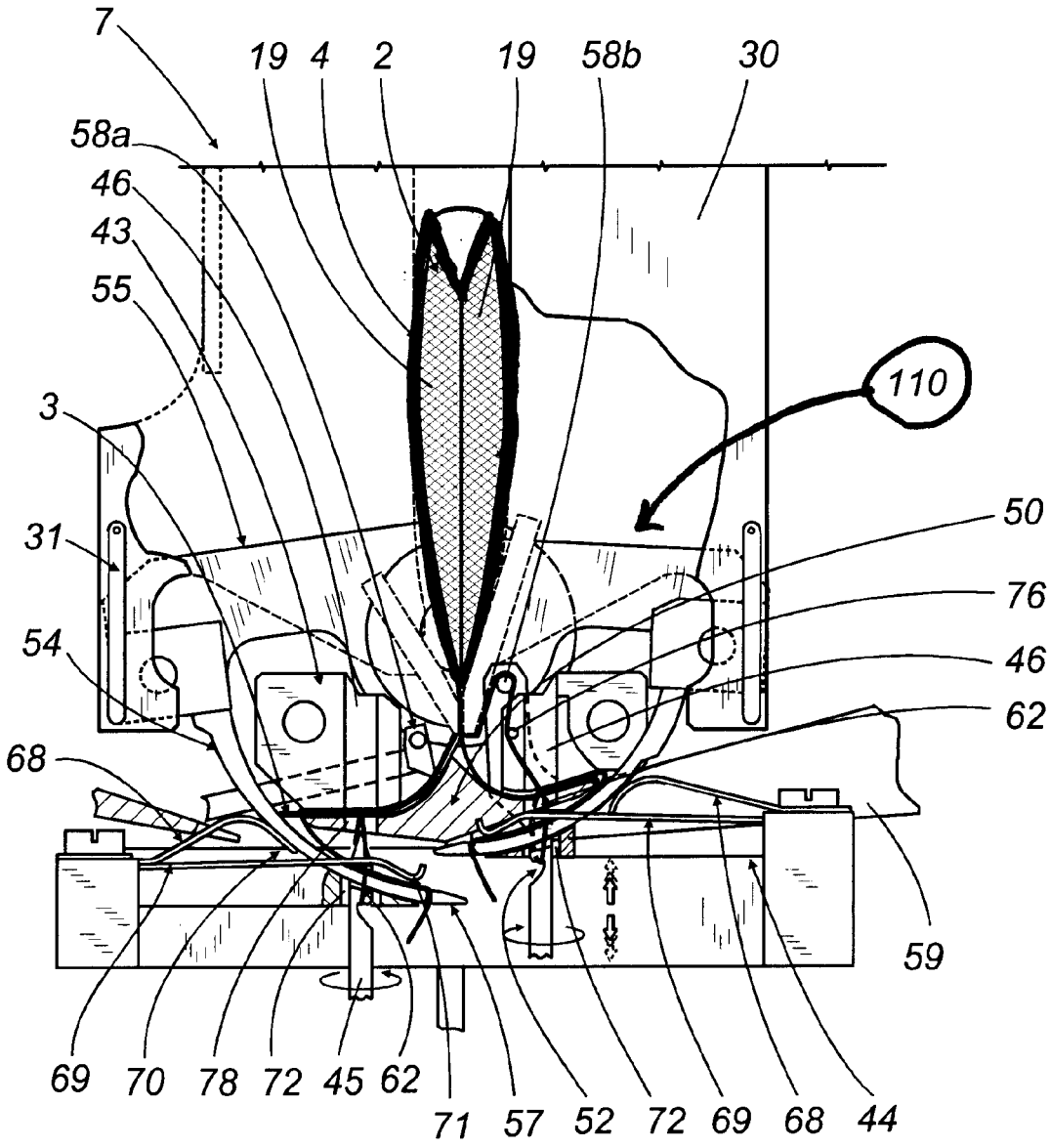

At this point, the interceptor elements 54 are simultaneously moved towards the needles 45 (FIGS. 11D and 11E). During the first part of their movement towards the needles 45, the two interceptor elements 54 intercept the respective lengths 40 of thread which, as a result, are arranged in a broken, mixed line, with a vertex 74 at the zone in which the end 57 of the interceptor elements 54 makes contact with the thread 5.

After a first section of the forward stroke towards the needles 45, the ends 57 of the interceptor elements 54 move, on both sides of the gripper 7, to the end sections 70 of the first elastic plates 68 relative respectively to the tag 3, and the top 12 of the filter bag 2. In this condition, the thread 5 is clamped and held with its vertices 74 between the ends 57 of the interceptor elements 54 and the elastic plates 68, which are angled tangentially to the trajectory of the ends 57, and which make contact with the interceptor elements 54 as friction clamping means.

In other words (FIGS. 11C, 11D) the lengths 40 of thread 5 are divided into two consecutive segments, separated by the vertex 74. A first segment is held taut between the vertices 74 and the lateral projections 32 of the gripper 7 teeth 30. The second segment is held across the top of the cavity 46 in the stops 43. Obviously, this applies on both heads 41. While the interceptor elements 54, during their stroke towards the needles 45, stop for a brief interval, the needles 45 are moved forward towards the wheel 6 along the longitudinal axis, through the tag 3 and the top 12 of the filter bag 2 (see FIGS. 4E-1, 11C and 11D) and penetrating the cavities 46 in the stops 43 with both eyes 51, 52. The angle of the needles 45 about the axis is such that the segments of thread in the cavities 46 are caught in the eye 52 of the needles 45 furthest from the point. When the thread 5 has been caught in the eye 52, the translation of the needles 45 is inverted and the needles 45, moving in the opposite direction (see FIGS. 4E-2 and 11D), force the lengths 40 of thread 5 to pass through the tag 3 and the top 12 of the filter bag 2, forming corresponding loops 62 in which the thread 5 is doubled (FIGS. 4E-2 and 11E). A subsequent rotation of the needles 45 about their longitudinal axes through an angle of at least 180°, or larger angles, for example, multiples of said angle (see FIG. 4E-3), allows the thread 5 to be wound around itself, tensioning and tightening the loop 62 which, when tightened, attaches the thread 5 close to the eye 51 closest to the point and, at the same time, allows the eye 51 to be angled relative to the trajectory of the interceptor elements 54.

Following said angling, the interceptor elements 54 continue their forward movement (see FIGS. 4E-4 and 11F) towards the needles 45 and bring the section of thread 5 between the vertices 74 and the lateral projections 32 through the loops 62, interlacing the thread 5 (in such a way that, when tightened, it forms a knot 63) due to the thrust of the interceptor elements 54, which thread the thread 5 through the eyes 51 closest to the point of the needles 45. After passing through the loops 62, as the interceptor elements 54 move towards the end of their stoke, the thread 5, pushed by the ends 57, is forced between the end sections 71 of the second elastic plates 69 and the corresponding opposite contact surfaces 77 of the support body 47. After reaching the final position in which they are as close as possible to the needles 45, the interceptor elements 54 invert their direction of movement and, as the end 57 gradually disengages from the second elastic plate 69 (FIG. 11G), the thread 5 is released and remains held between the end 71 of the second elastic plate 69 and the surface 77 of the support body 47, which are in contact with one another.

Figure 11G:
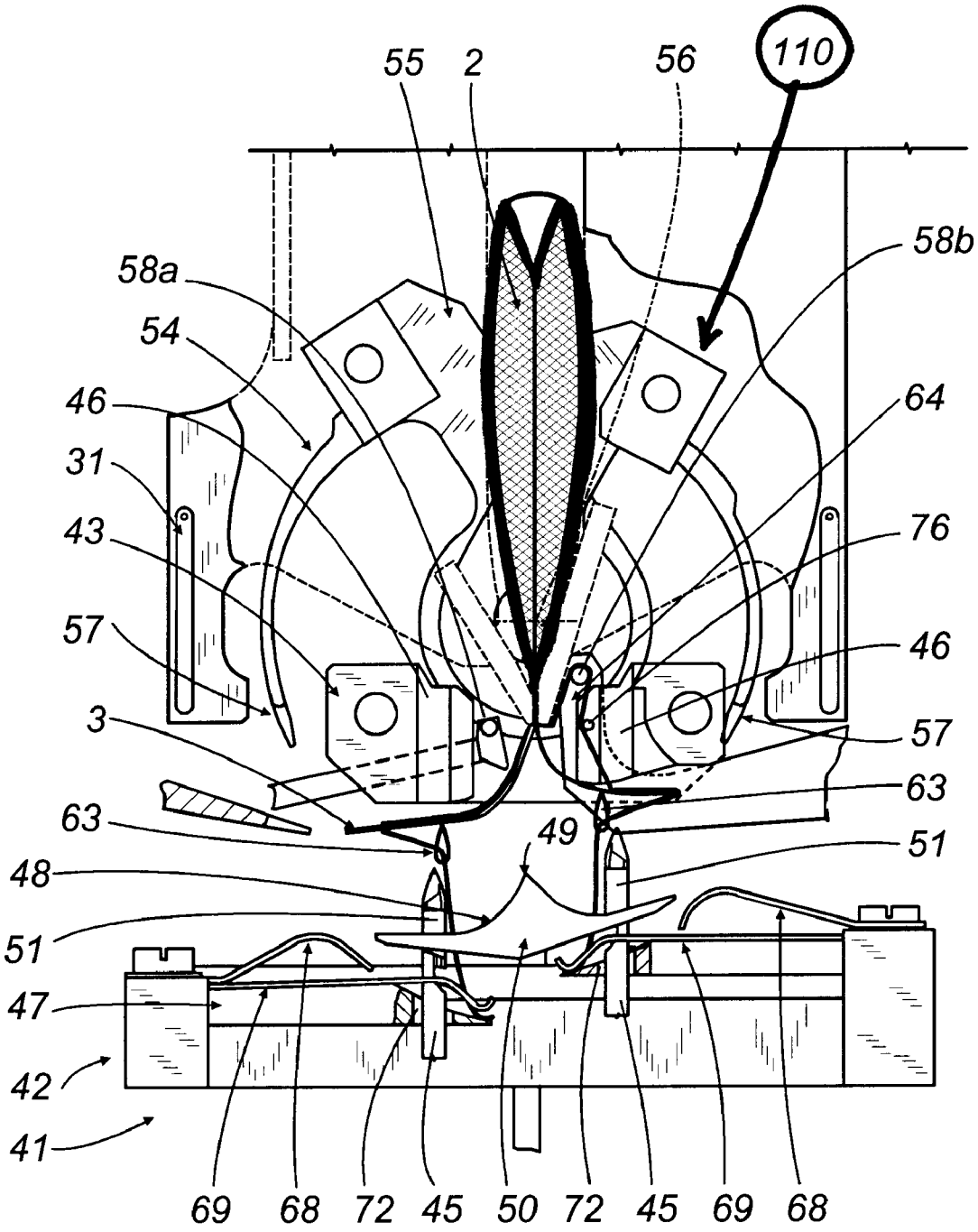

An oscillation of the needles 45 longitudinally to the relative axes (again see FIG. 4E-4), releases the loops 62 from the eyes 52 furthest from the point of the needles 45, allowing the interlaced configuration illustrated in FIG. 5E-5 to be obtained, where the free end of the thread 5 is held, as indicated, by the support body 47 (FIG. 11G).

Figure 11H:
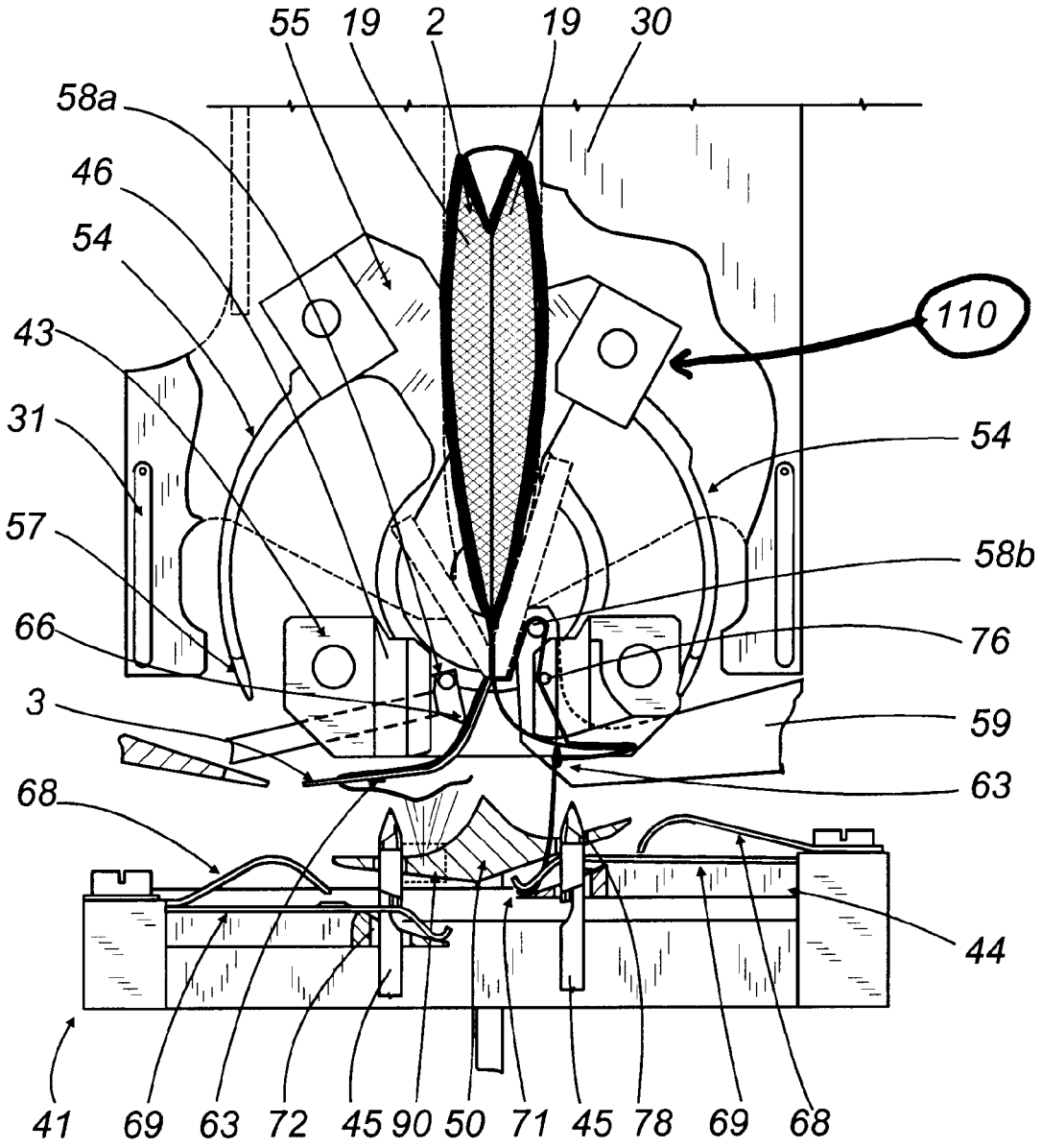
Figure 11I:
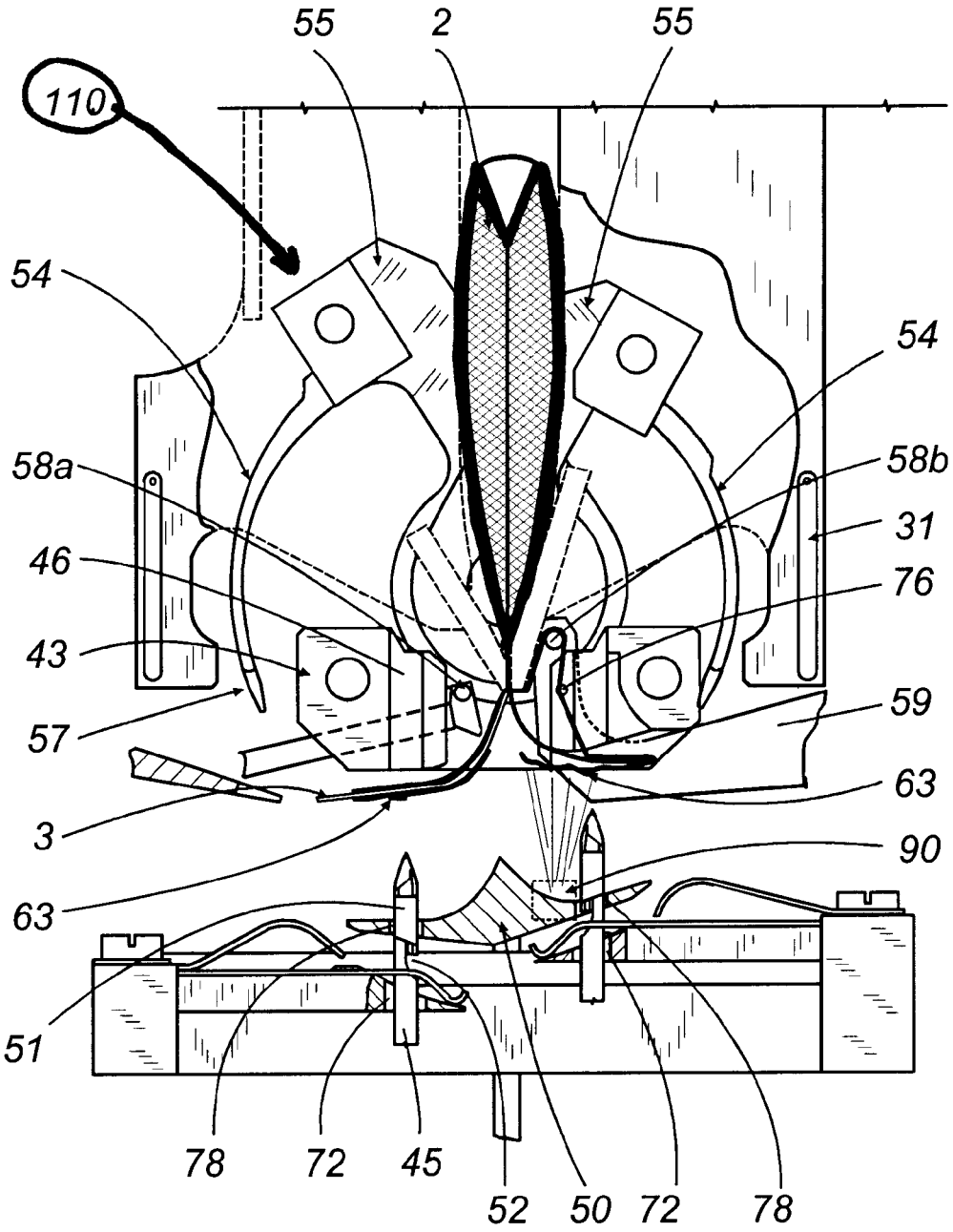

At this point, the pressure pads 44 and the presser body 50 move away from the wheel 6, in a radial direction, towards the point corresponding with their home position. As a result of this movement, the section of thread held between the second elastic plate 69 and the surface 77 of the support body 47 is first pulled, gradually tightening the interlaced configuration and forming the knot 63, then, as the movement of the pressure pads 44 and the presser body 50 continues, the section of thread detaches from the second elastic plate 69 and hangs in the space between the wheel 6 and the support body 47 (FIG. 11H). Since the second elastic plates 69 relative to the two operating heads 41 of the knotting station 15 are located at different distances from the axis of rotation 16 of the wheel 6, the passage of the two sections 40 of thread to the hanging state occurs in two separate stages, so that suitably angled air jet means 90, activated twice in succession, blow the hanging sections of thread 5, allowing first one, then the other, to be gathered in the space between the tag 3 and the top 12 of the filter bag 2 (FIGS. 11H and 11I).

Figure 11L:
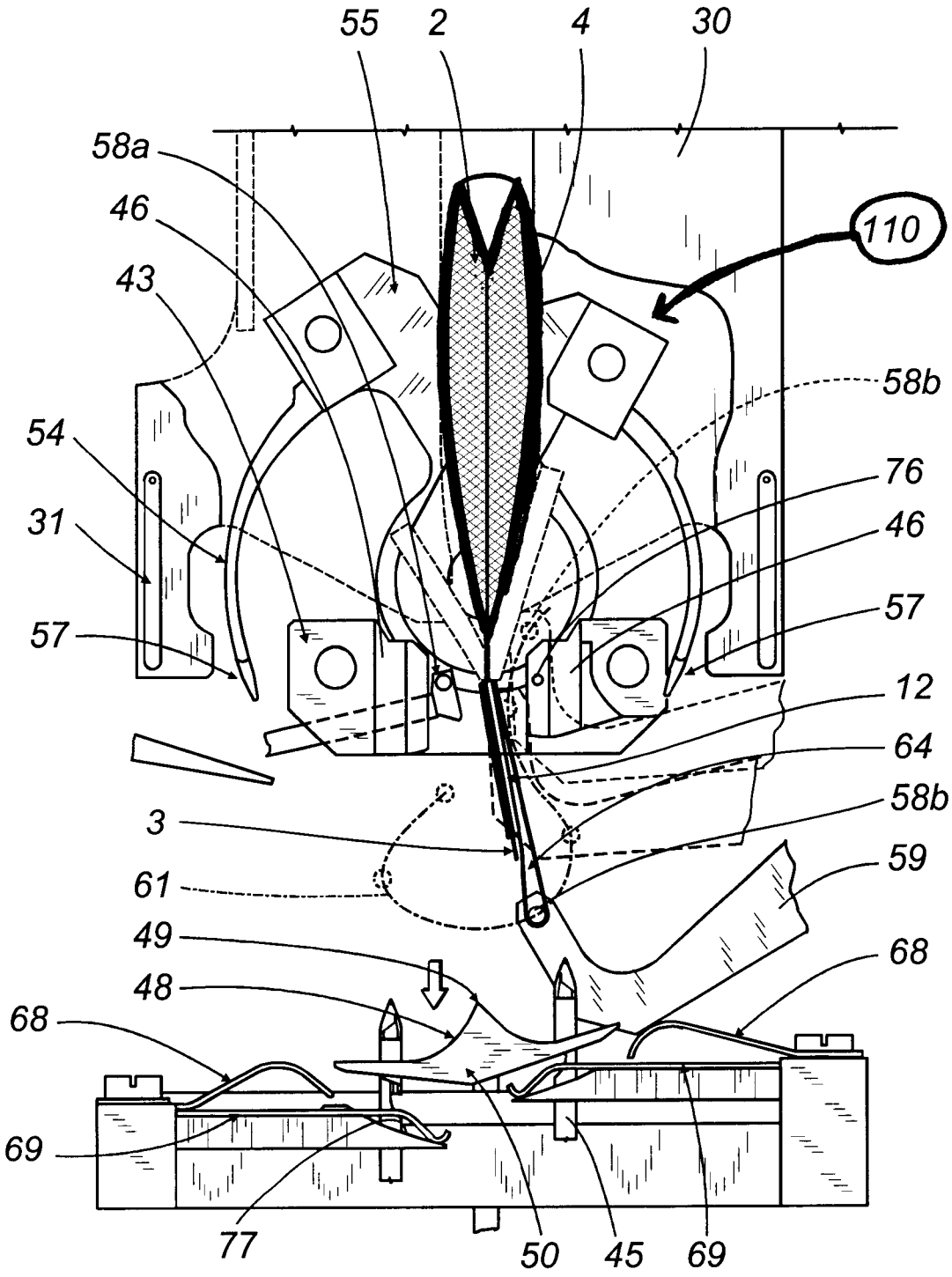
Figure 11M:
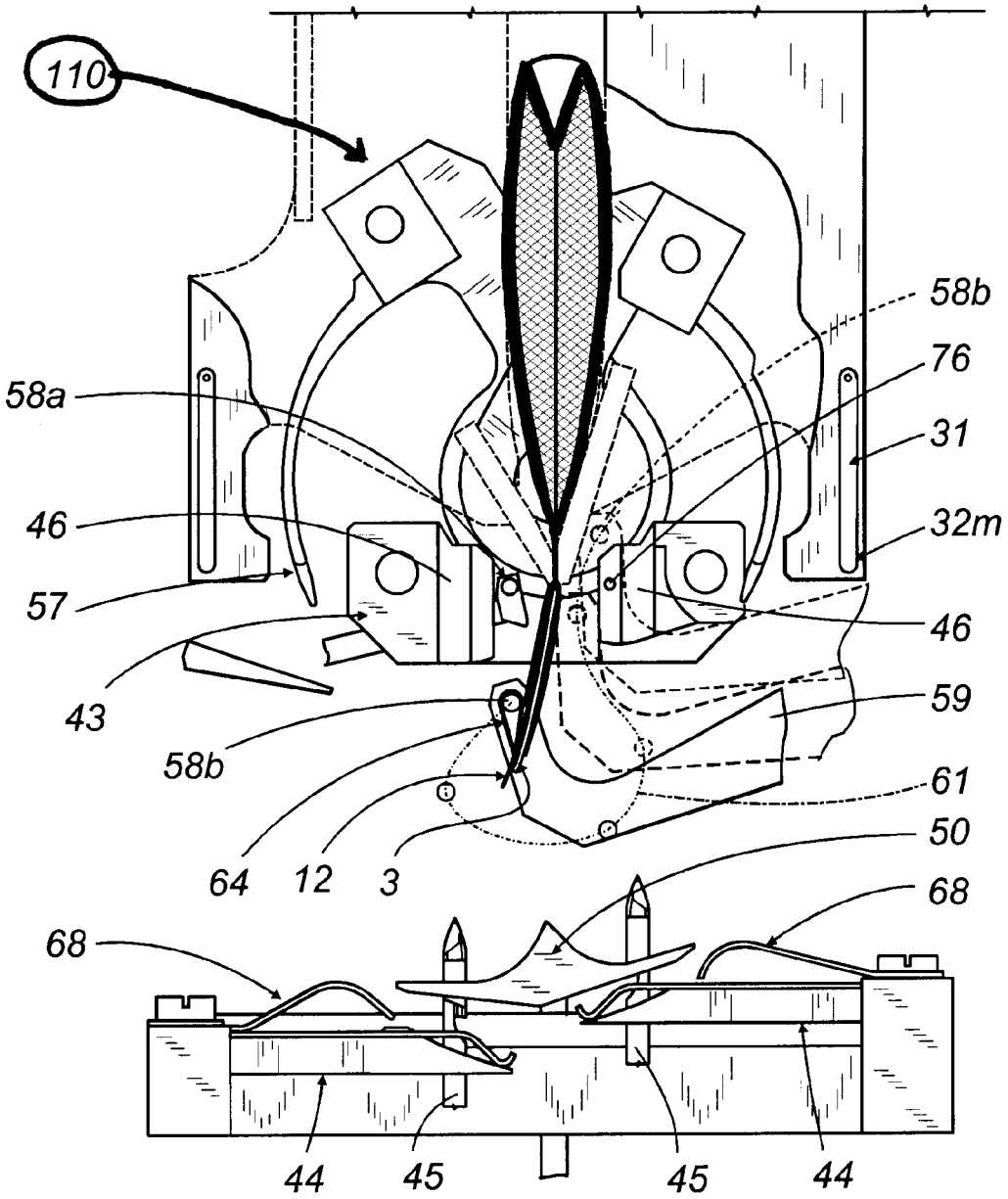

On the operating head 41 relative to the top 12 of the filter bag 2, the extended pin **58*b* follows its trajectory 61, away from the axis of rotation 16 of the wheel 6 (FIG. 11L). During the final stage of said trajectory 61, the pin 58*b* performs a movement which causes the thread 5 to surround both the top 12 and the tag 3 of the filter bag 2 and, in particular, the small loop 64 formed by the excess thread 5 penetrates the notch 65 made in the tag 3 (FIG. 5E-6) in the previous feed station 14 (FIG. 11M). In said notch 65, the loop 64 is then definitively released following the translation of the pin 58*b* parallel with the axis of rotation 16 of the wheel 6, proceeding towards its home position in which it allows the wheel 6 to rotate freely; the same movement occurring simultaneously for the pin 58*b* relative to the tag 3**.

In the subsequent stages illustrated in FIGS. 5F and 5G, the fully formed filter bag 2 is subjected to further operations, for example, packaging in a protective sachet **65*b***, operations which are not described, since they are not part of the subject matter of the present invention.

From the above operating description, it is evident that the interceptor elements 54 repeatedly interact firstly with the first elastic plate 68, then with the second elastic plate 69 and the relative opposite surface 77 of the support body 47, being subjected to complex cyclic stresses, of relatively high intensity considering the small dimensions of the interceptor elements 54. In the long-term, this may lead to some disadvantages in terms of their mechanical durability and reliability.

In order to prevent such potential disadvantages, an alternative embodiment, illustrated in FIGS. 12 and 13, has interceptor elements 54 shaped like a curved fork, with two teeth 101 and 102, set side by side, which are of different sizes and shapes, and project from a single body 100.

A first, larger tooth 101, has a free end 104 in the shape of an extended trapezium, slightly prominent relative to a much thinner free end 105 of the second tooth 102 which is tapered and finer than the first tooth 101 and has a projection 103, designed to intercept the thread 5. The projection 103 is located on the side of the second tooth 102 furthest from the first tooth 101 and is set back from the free end 105 of the second tooth 102.

In the present alternative embodiment, the teeth 101 and 102 and the projection 103 have separate functions, the second tooth 102 only drawing the thread 5 and the first tooth 101 moving the second plates 69 towards or away from the support body 47. When the interceptor element 54 performs its characteristic alternating movements, the first tooth 101, having a free end 104 which projects further than the free end 105 of the second tooth 102, can insert itself between the second elastic plates 69 of the pressure pads 44 and the relative support body 47 before the free end 105 of the second tooth 102 reaches them.

The latter, therefore, moves between the second elastic plates 69 and the support body 47, drawing the thread 5 between them and releasing it there, as described, with the minimum of mechanical stress and without jamming or counteracting the second plates 69.

The invention described can be subject to modifications and variations without thereby departing from the scope of the inventive concept. Moreover, all the details of the invention may be substituted by technically equivalent elements.

What is claimed is:

1. A machine for making filter bags containing a product for infusion, having a pick-up tag connected to the top of the filter bag by an intermediate thread, said machine comprising a wheel which rotates with a stepping motion about its own axis of rotation, being equipped with grippers, the wheel bringing the grippers into contact with a series of operating stations, comprising at least one station for folding a tubular semi-finished product containing the product for infusion, and at least one station for knotting the thread, the machine further comprising thread feed means which operate on the thread fed between pairs of the grippers positioned one after another along the edge of the wheel; said feed means presenting a fork with extended teeth angled parallel with the axis of rotation of the wheel, the fork being supported by an arm which oscillates between a home position, in which the teeth are outside the wheel, and an operating position, in which the teeth are between two consecutive grippers on the wheel.

2. The machine according to claim 1, wherein one of the grippers between Which the feed means operate is positioned at the folding station for the tubular semi-finished product.

3. The machine according to claim 1, wherein the teeth have faces which meet at least at one shared vertex.

4. The machine according to claim 3, wherein said faces are flat.

5. The machine according to claim 1, wherein the feed means are designed to give the thread a segmented configuration between two consecutive grippers on the wheel.

6. The machine according to claim 5, wherein the segmented configuration envisages sections of thread angled in directions corresponding to the radii and chords of the wheel.

7. The machine according to claim 1, wherein the knotting station comprises a knotting device equipped with needles for knotting the thread to the tag and to the top of the filter bag, the needles being brought into contact with tag and bag-top stops and with respective mobile needle interceptor elements, wherein at least one of the needles has a first and a second eye, being located at different distances from the point, said at least one needle being moved in such a way as to pick up the thread with the second eye, forming a loop in which the thread is associated with the first eye, the interceptor element being moved in time with the needle so that it passes through the first eye, pushing a section of thread through the above-mentioned loop.

8. The machine according to claim 7, wherein the first and second eyes are located on two distinct transversal planes passing through the longitudinal axis of the needle.

9. The machine according to claim 8, wherein the transversal planes passing through the longitudinal axis of the needle and relative to the first and second eyes are at right-angles to one another.

10. The machine according to claim 7, wherein the knotting device comprises a single presser body for pressing the tag and the top of the filter bag against the stops.

11. The machine according to claim 10, wherein the presser body has faces which meet at a shared tip.

12. The machine according to claim 11, wherein the faces of the presser body are curved.

13. The machine according to claim 12, wherein the longitudinal cavity is open at the side.

14. The machine according to claim 10, wherein the knotting station comprises mobile pressure pads, being synchronised with the presser body, the pads comprising a support body to which first elastic plates are connected, being designed to interact with the interceptor element and clamp the thread between the first elastic plate and the interceptor element.

15. The machine according to claim 10, wherein the knotting station comprises mobile pressure pads, being synchronised with the presser body, the pads comprising a support body to which second elastic plates are connected, being designed to interact with the interceptor element and to allow the interceptor element and thread to pass through them, then to be disengaged from the interceptor element, holding the thread between the second elastic plate and the support body.

16. The machine according to claim 15, wherein the interceptor element is shaped like a fork and has two teeth, being positioned side by side and having longitudinally offset free ends; corresponding with the alternative motion of the interceptor element, the first tooth, having the first free end which projects furthest, inserts itself between the second elastic plates of the pressure pads and the relative support body, separating them from the support body and vice versa; the second tooth being designed to move back and forth between the second elastic plates and the support body in such a way that it draws and releases the thread there after the first tooth and subjects the second elastic plates to the minimum of stress.

17. The machine according to claim 16, wherein the second tooth has a projection designed to intercept the thread, being located on the side of the second tooth and set back from the free end.

18. The machine according to claim 7, wherein a longitudinal cavity passes through the stop elements, said cavity being shaped in such a way that the needles can pass through it.

19. The machine according to claim 7, wherein it comprises two interceptor elements, being located at variable distances from the axis of rotation of the wheel.

20. The machine according to claim 7, wherein it comprises air jet means whose activation allows sections of thread hanging in the space between the tag and the top of the filter bag to be gathered up.

21. The machine according to claim 1, wherein at least the first eye is open at the side.

22. The machine according to claim 1, wherein at least one needle rotates about their own longitudinal axes.

23. The machine according to claim 22, wherein the needle or needles rotate about their own longitudinal axes through an angle of at least 90°.

24. The machine according to claim 22, wherein the needle or needles rotate about their own longitudinal axes through an angle of at least 180° or multiples of said angle.

25. The machine according to claim 1, wherein at least one needle rotates through an angle whose size is such that it allows the thread to wind around itself and to determine a corresponding tensioning and tightening of the loop.

26. The machine according to claim 1, wherein the grippers have teeth with thread support elements, consisting of leaf spring elements designed to hold the thread, between themselves and the support elements.

27. A machine for making filter bags containing a product for infusion, having a pick-up tag connected to the top of the filter bag by an intermediate thread, said machine comprising a wheel which rotates with a stepping motion about its own axis of rotation, being equipped with grippers, the wheel bringing the grippers into contact with a series of operating stations, comprising at least one station for folding a tubular semi-finished product containing the product for infusion, and at least one station for knotting the thread, the knotting station comprising a knotting device having needles for knotting the thread to the tag and the top of the filter bag, the needles being brought into contact with stop elements for the tag and the top of the bag and with respective interceptor elements which are mobile relative to the needles, at least one of the needles presenting a first and second eye, being located at different distances from the point, the needle or needles being moved in such a way as to pick up the thread with the second eye, forming a loop in which the thread is associated with the first eye, the interceptor element being moved in time with the needle so that it passes through the first eye, pushing a section of thread through the loop; the knotting device comprising a single presser body for pressing the tag and the top of the filter bag against the stops, said presser body having faces which meet at a shared tip.

28. The machine according to claim 27, wherein in the first and second eyes are located in two distinct transversal planes passing through the longitudinal axis of the needle.

29. The machine according to claim 28, wherein the transversal planes passing through the longitudinal axis of the needle and relative to the first and second eyes are at right-angles to one another.

30. The machine according to claim 28, wherein at least the first eye is open at the side.

31. The machine according to claim 28, wherein the needle or needles rotate about their own longitudinal axes.

32. The machine according to claim 31, wherein the needle or needles rotate about their own longitudinal axes through an angle of at least 90°.

33. The machine according to claim 31, wherein the needle or needles rotate about their own longitudinal axes through an angle of at least 180° or multiples of said angle.

34. The machine according to claim 27, wherein the needle or needles rotate through an angle whose size is such that it allows the thread to wind around itself and to determine a corresponding tensioning and tightening of the loop on the needle.

35. The machine according to claim 34, wherein the longitudinal cavity is open at the side.

36. The machine according to claim 27, wherein the faces of the presser body are curved.

37. The machine according to claim 27, wherein a longitudinal cavity passes through the stop elements, said cavity being shaped in such a way that the needles can pass through it.

38. The machine according to claim 27, wherein the grippers have teeth with thread support elements, consisting of leaf spring elements designed to hold the thread, between themselves and the support elements.

39. A method for making filter bags containing a product for infusion, having a pick-up tag connected to the top of the filter bag by knotting an intermediate thread, the method comprising stages for forming a loop in the thread using at least one needle, the latter having a first and second eye, being located at different distances from the point, and moved in such a way as to pick up the thread with the second eye, associating it with the first eye; winding the thread about itself and angling the loop relative to an interceptor element, being moved in time with the needle so that it passes through the first eye, pushing a section of thread through the loop; the method further comprising a stage during which, after passing through the loop, the thread is held between a thread interceptor element and a support body having an elastic plate which can be brought into contact with the interceptor element, holding the thread between the two.

40. The method according to claim 39, wherein it comprises a further stage during which the thread is held, between a second elastic plate and a support body and a stage during which a knot in the thread is tightened by moving the support body away from the wheel.

41. The method according to claim 39, wherein it comprises a stage during which the thread is gathered between the tag and the filter bag, following tightening of the knot.

42. The method according to claim 45, wherein the gathering stage is effected by air jet means, being designed to act upon hanging sections of thread.

* * * * *